US005158017A

United States Patent [19]

MacConnell et al.

[11] Patent Number: 5,158,017

[45] Date of Patent: Oct. 27, 1992

[54] PRESS DAMPENING SYSTEM

[75] Inventors: Edward P. MacConnell, Arlington; Robert King, Dallas; Donald L. Frank, Mesquite, all of Tex.

[73] Assignee: Sun Graphic Technologies, Inc., Fort Worth, Tex.

[21] Appl. No.: 580,632

[22] Filed: Sep. 11, 1990

[51] Int. Cl.[5] ..... B41L 25/02

[52] U.S. Cl. ..... 101/148; 101/348; 101/451; 101/492; 101/DIG. 38

[58] Field of Search ..... 101/147, 148, 450.1, 101/451, 452, 422, 492, DIG. 38, 345, 349, 350, 351, 352

[56] References Cited

U.S. PATENT DOCUMENTS

| | | | |
|---|---|---|---|
| 3,168,037 | 2/1965 | Dahlgren | 101/148 |
| 3,467,008 | 9/1969 | Domotor | 101/142 |
| 3,937,141 | 2/1976 | Dahlgren | 101/148 |
| 3,986,452 | 10/1976 | Dahlgren | 101/148 |
| 4,290,360 | 9/1981 | Fischer | 101/148 |
| 4,438,694 | 3/1984 | Parkins | 101/152 |
| 4,440,082 | 4/1984 | Beisel | 101/148 |
| 4,524,690 | 6/1985 | Omori | 101/148 |
| 4,577,556 | 3/1986 | Fischer | 101/148 |
| 4,724,764 | 2/1988 | MacPhee et al. | 101/451 |
| 4,741,269 | 5/1988 | Aylor | 101/148 |
| 4,841,855 | 6/1989 | Marcum | 101/148 |
| 4,887,533 | 12/1989 | Lemaster | 101/492 |
| 4,913,943 | 4/1990 | Goossen | 428/36.1 |
| 4,932,319 | 6/1990 | Switzall | 101/147 |
| 4,944,223 | 7/1990 | Ishii | 101/148 |
| 4,949,637 | 4/1990 | Keller | 101/148 |
| 4,986,176 | 1/1991 | Ishii | 101/148 |

*Primary Examiner*—Edgar S. Burr
*Assistant Examiner*—Eric P. Raciti
*Attorney, Agent, or Firm*—Geoffrey A. Mantooth

[57] ABSTRACT

A dampening system has a pan for containing dampening fluid, and transfer and metering rollers for bringing dampening fluid up out of the pan. A transition roller contacts one of the transfer and metering rollers. The transition roller is movable between first and second position. In the first position, the transition is off of the plate cylinder and dampening fluid is applied to the plate cylinder by ink form rollers. In the second position, the transition roller is on the plate cylinder. Another version of the dampening system has a bridge roller between the transition roller and a ink form roller, which bridge roller is movable between the third and fourth positions. In the third position, the bridge roller is on the transition roller. In the fourth position, the bridge roller is off of the transition roller. The dampening system can dampen the plate cylinder without the use of alcohol. The transition roller is rotated by a separate motor so that its speed is controlled independently of the other rollers. When the transition roller is on the plate cylinder, it can be slowed down to clean hickeys off of the plate cylinder. When the plate cylinder is clean, it can be moved off of the plate cylinder or speeded up to the same speed as the plate cylinder. A controller is provided to automatically adjust the amount of dampening fluid being applied to the plate cylinder by regulating the speed of the transfer and metering rollers.

15 Claims, 10 Drawing Sheets

PRESS DAMPENING SYSTEM

FIELD OF THE INVENTION

The present invention relates to printing presses such as lithographic printing presses, and in particular to dampening systems that apply dampening fluid to press components.

BACKGROUND OF THE INVENTION

Dampening systems are used on lithographic printing presses to apply dampening fluid to a plate cylinder on the press. The plate cylinder has wrapped around it a chemically treated plate with hydrophilic (water-loving) areas and oleophilic (oil-loving) areas in its outside surface. These hydrophilic and oleophilic areas are arranged in a pattern on the printing plate to produce the desired image on paper. The oleophilic areas attract the oil-based ink and repel the water-based dampening fluid, while the hydrophilic areas attract the dampening fluid and repel the ink.

The dampening system applies dampening fluid either directly to the plate cylinder by way of a separate dampening roller or indirectly to the plate cylinder by way of the inking form rollers. The form rollers apply a thin layer of ink and dampening fluid to the respective areas of the printing plate on the plate cylinder. The proper proportions of ink and dampening fluid as applied to the plate cylinder (referred to as the ink-water balance) must be maintained for the proper application of the ink to the paper. If there is too much dampening fluid relative to the ink, the ink on the paper will lose color and fade. If there is too little dampening fluid, ink will appear on the paper in non-print areas.

Prior art dampening systems suffer from several disadvantages. One such disadvantage is the use of isopropyl alcohol as a wetting agent in the dampening fluid. The dampening system of U.S. Pat. No. 3,168,037 requires a wetting agent such as alcohol to properly mix the ink and water together.

The use of alcohol was initially hailed by the printing industry as an improvement over the prior art, which used a cloth (specifically molleton) covered ductor roller and cloth covered dampening form rollers. Unfortunately, the cloth covers on the rollers required frequent changes, resulting in down time of the press. Furthermore, the dampening system produced variations in ink color throughout a print run.

The use of alcohol in the dampening system of the '037 patent eliminated the need for cloth covers and ducting rollers, thereby increasing the operating time of a press and reducing the maintenance requirements. Isopropyl alcohol, however, is dangerous to work with, being highly flammable and carcinogenic. Alcohol evaporates easily, filling the press room with fumes that are breathed by personnel. Alcohol evaporation can be reduced by the installation of a refrigeration system on the press to cool the dampening fluid. Alternatively, a high capacity ventilation system can be installed in the press room to quickly remove alcohol vapors. In fact, some jurisdictions require such ventilation systems for safety reasons. Either alternative, refrigeration or ventilation, is expensive. In addition, alcohol is expensive to buy thereby increasing the operating costs of a print shop.

Alcohol substitutes have been developed, but none are entirely satisfactory. Such substitutes leave residues on the rollers, requiring the press to be stopped periodically for roller deglazing In addition, alcohol substitutes are difficult to use with respect to achieving the proper ink-water balance.

Another disadvantage of prior art dampening systems is that frequent manual adjustments (mechanical and electrical) are required during the operation of the press to change the amount of dampening fluid that is applied or metered into the system Such adjustments are required because the conditions of the press change during operation, thereby affecting the ink-water balance. When a press is first started in the morning, all of its components are at room temperature. As the press operates over a period of time however, the components heat up. This reduces the viscosity of the ink, thereby allowing more ink to flow Consequently, more dampening fluid is required The operator is required to monitor and continuously adjust the metering of the dampening fluid. However, on most high speed presses, the operator is kept busy enough monitoring the other functions of the press.

Another disadvantage relates to the removal of hickeys from the plate cylinder All printing presses suffer from problems caused by hickeys. Hickeys are small particles of matter, such as paper, dust, dried ink, etc., that adhere to the plate cylinder and the blanket cylinder. Hickeys adhere to the plate cylinder, causing imperfections in the application of ink to the printed paper. The prior art uses such techniques as manual cleaning with a scraper blade or cleaning with an operator's thumbnail Both of these techniques, which are performed during the operation of the press, are highly dangerous, and run the risk of both operator injury and press damage Alternatively, the press is frequently stopped and the plate cylinder is washed down resulting in down time of the press.

The prior art has used dampening systems to clean hickeys off of plate cylinders. Domotor, U.S. Pat. No. 3,467,008 teaches the use of either an inking or a dampening roller to clean hickeys off of the plate cylinder. The roller contacts the plate cylinder and is rotated at different speeds than the plate cylinder MacPhee, U.S. Pat. No. 4,724,764 teaches the use of a dampening roller and an ink receptive roller contacting the dampening roller to remove hickeys from the plate cylinder. The dampening roller contacts the plate cylinder and both the dampening roller and the ink receptive roller are rotated at differential speeds with respect to the plate cylinder.

The problem with the Domotor and the MacPhee systems is that once the hickeys are cleaned off of the plate cylinder, they are either mixed in with the press inking system or accumulate on an ink roller, wherein the hickeys can be reapplied to the plate cylinder. Furthermore, the form rollers that rotate at a differential speed with respect to the plate cylinders are in constant contact with the plate cylinder during the operation of the press. This produces unnecessary wear on the printing plate that is on the plate cylinder.

SUMMARY OF THE INVENTION

It is an object of the present invention to provide a dampening system that eliminates the use of alcohol and minimizes the use of alcohol substitutes or wetting agents.

It is a further object of the present invention to provide a dampening system that minimizes press down time and maintenance, increases the efficiency of the operation of a press and enhances print quality.

Still another object of the present invention is to provide an apparatus for removing hickeys from the plate cylinder during the operation of the press.

Still another object of the present invention is to provide a system that automatically controls and adjusts the amount of dampening fluid that is metered onto the plate cylinder in response to changing press conditions.

The dampening system of the present invention includes a pan, first and second dampening rollers, first drive means, a transition roller and second drive means. The pan is for containing dampening fluid. The first and second dampening rollers are in contact with each other at a nip. One of the first and second dampening rollers is located in the pan so as to pick up dampening fluid from the pan. One of the first and second dampening rollers is hydrophilic. The first drive means rotates the first and second dampening rollers. The transition roller is adapted for applying dampening fluid to the plate cylinder. The transition roller, which is ink receptive, is in rotative contact with one of the first and second dampening rollers and is adapted to be rotatively coupled with one of the inking rollers on the press. Dampening fluid is applied to the plate cylinder through the inking rollers when the dampening system is mounted to the press. The second drive means rotates the transition roller at a surface speed that is independent of the surface speeds of the other rollers, wherein the press can be operated free of alcohol and other wetting agents.

In one aspect, one of the first and second dampening rollers is hydrophilic. The first drive means rotates the second dampening roller at a faster surface speed than the first dampening roller. A bridge roller is provided, which roller is in contact with the transition roller and one of the inking rollers. The bridge roller is ink receptive.

A method of dampening the plate cylinder includes the steps of providing dampening fluid that is adapted to dampen the plate cylinder. The dampening fluid has no wetting agent therein. Plural ink receptive rollers are provided, which rollers provide a path to the inking rollers in the press. One of the ink receptive rollers contacts one of the inking rollers. A hydrophilic roller is provided, which roller is in contact with one of the ink receptive rollers. The ink receptive rollers and the hydrophilic roller are rotated at differential speeds with respect to each other such that the ink receptive rollers rotate at faster surface speeds than the hydrophilic roller and such that the one ink receptive roller that contacts one of the inking rollers rotates at a faster surface speed than the other ink receptive rollers. Dampening fluid is applied to the plate cylinder by way of the hydrophilic and ink receptive rollers.

With the dampening system of the present invention, the press can be operated without any alcohol in the dampening fluid. In prior art dampening systems, alcohol is used as a wetting agent to assist the proper mixing of the water-based dampening fluid into the oil-based ink. However, alcohol evaporates easily, filling the press room with fumes that are carcinogenic and highly flammable. Alcohol substitutes have been used in place of alcohol, however such substitutes are inferior wetting agents compared to alcohol. Furthermore, it is difficult to achieve a satisfactory ink-water balance with alcohol substitutes. Many dampening systems are unable to operate properly with alcohol substitutes, and instead require alcohol. The dampening system of the present invention causes dampening fluid to traverse several nips, where the ink receptive rollers rotate at differential speeds, before the dampening fluid reaches the plate cylinder. In addition, the transition roller is rotated independently of the other rollers in the press and in the dampening system.

In yet another aspect of the dampening system of the present invention, the transition roller is rotatably mounted to the frame of the dampening system by way of mounting means. The mounting means allows the transition roller to be movable between first and second positions. When the transition roller is in the first position, the transition roller is adapted to be rotatively coupled to one of the inking rollers such that the dampening system is adapted to apply dampening fluid to the plate cylinder by way of the inking rollers When the transition roller is in the second position, the transition roller is adapted to break the rotative coupling with the one inking roller and the transition roller is adapted to contact the plate cylinder. The second drive means rotates the transition roller at speed independently of the other rollers These speeds include a speed that is different from the speed of the plate cylinder, wherein when the transition roller is in the second position, the transition roller is adapted to remove hickeys from the plate cylinder, which hickeys are carried to the pan.

In one aspect, the dampening system further includes actuation means for moving the transition roller between the first and second positions. The actuation means is coupled with the frame and to the mounting means.

The provision of the transition roller moving between first and second positions allows the dampening system to apply dampening fluid to the plate cylinder through the inking rollers in one position, and to pick hickeys off of the plate cylinder in the other position. When the transition roller is in the hickey picking position, the transition roller is driven at a speed that is different from the plate cylinder speed. When the transition roller is in the hickey picking position, it is separated from the inking rollers so that hickeys that have been picked off of the plate cylinder are carried to the pan and not into the inking system, where they could be reapplied to the plate cylinder. Because the transition roller is contacting the plate cylinder at a differential speed for only short periods of time, wear on the printing plate is reduced.

In yet another aspect, the dampening system includes a pan, first and second dampening rollers, first drive means, a third dampening roller, second drive means, sensor means, and controller means. The third dampening roller is in contact with one of the first and second dampening rollers and is adapted to apply dampening fluid to the plate cylinder. The third dampening roller encounters rotational resistance when the dampening system is mounted onto the press and the press is operating. The rotational resistance is due to the viscosity of a mixture of ink and dampening fluid on the third dampening roller The sensor means senses the rotational resistance of the third dampening roller. The controller means automatically controls the surface speed of the first and second dampening rollers. The controller means has an input that is connected with the sensor means and an output that is connected with the first drive means. The controller means causes the first drive means to rotate the first and second dampening rollers at a predetermined surface speed which corresponds to a predetermined rotational resistance of the third dampening roller. The control means causes the first drive means to correspondingly change the surface speed of the first and second dampening rollers in response to changes in rotational resistance of the third dampening roller such that when the rotational resistance as sensed by the sensor means decreases below the predetermined rotational resistance the controller means causes the first drive means to decrease the surface speed of the first and second dampening rollers, and when the sensed rotational resistance increases above the predetermined rotational resistance the controller means causes the first drive means to increase the surface speed of the first and second dampening rollers.

In one aspect, the sensor means is a first sensor means. A second sensor means is provided, which is adapted to sense the speed of the press rollers when the dampening system is mounted onto the press. The controller means includes a drive controller for controlling the second drive means so as to control the surface speed of the third dampening roller. The drive controller has an input and an output, with the input being connected to the second sensor means and the output being connected to the second drive means. The drive controller controls the second drive means such that the surface speed of the third dampening roller is kept constant for a fixed press speed.

In another aspect, the dampening system includes a pan, first and second dampening rollers, first drive means, a third dampening roller, second drive means, first and second sensors, first and second controller means. The first sensor senses the rotational resistance of the third dampening roller. The second sensor is adapted to sense the speed of the press rollers when the dampening system is mounted onto the press. The first controller means controls the surface speed of the first and second dampening rollers. The first controller means has an input connected to the first sensor and an output connected to the first drive means. The first controller means causes the first drive means to rotate the first and second dampening rollers at a predetermined surface speed that corresponds to a predetermined rotational resistance of the third dampening roller. The second controller means controls the surface speed of the third dampening roller. The second controller means has an input that is connected to the second sensor and an output connected to the second drive means. The second controller means controls the second drive means such that the surface speed of the third dampening roller is kept constant for a fixed press speed and such that the surface speed of the third dampening roller correspondingly changes in response to changes in the press speed as sensed by the second sensor.

The controller means automatically adjusts the amount of dampening fluid being brought up by the transfer and metering rollers in response to the rotational resistance of the transfer roller. This automatically maintains the desired ink-water balance, and compensates for changing press conditions. The viscosity of the ink dampening fluid mixture on the transition roller is used to sense the ink-water balance. As the proportion of ink-to-water changes, the viscosity will correspondingly change, thereby affecting the rotational resistance encountered by the transition roller. By adjusting the speed of the transfer and metering rollers, the amount of dampening fluid can be controlled to maintain the viscosity of the ink dampening fluid mixture on the transition roller within a narrow range.

In yet another aspect, the dampening system includes a pan, first and second dampening rollers, first drive means, a third dampening roller, second drive means, a fourth roller, sensing means and control means. The third dampening roller is in contact with one of the first and second dampening rollers and is rotatably mounted to the frame. The fourth roller is adapted to contact one of the inking rollers and is adapted to contact the third dampening roller. The fourth roller is rotatably mounted to the frame by way of mounting means. The mounting means allows the fourth roller to move between first and second positions, wherein when the fourth roller is in the first position the fourth roller contacts the third dampening roller and when the fourth roller is in the second position the fourth roller is not in contact with the third dampening roller. The sensing means senses which position the fourth roller is in. The control means controls the second drive means so as to control the speed of the third dampening roller. The control means controls the second drive means such that the third dampening roller rotates at the same speed as the plate cylinder when the fourth roller is in the first position and the third dampening roller rotates at a different speed than the plate cylinder when the fourth roller is in the second position, wherein when the fourth roller is in the second position hickeys can be cleaned from the plate cylinder, which hickeys are carried to the pan.

In one aspect, the third dampening roller is rotatably mounted to the frame by way of mounting means that provides for the transition roller moving between a position where it is in contact with the plate cylinder and another position where it is in contact with the fourth roller.

The dampening system provides flexibility to operate in various modes, in order to provide alcohol-free operation for a wide range of printing operations When the dampening system operates with the transition roller acting as a form roller against the plate cylinder and the bridge roller contacts the transition roller, a more uniform layer of ink and dampening fluid can be applied to the plate cylinder.

DESCRIPTION OF PREFERRED EMBODIMENTS

Figure 1:
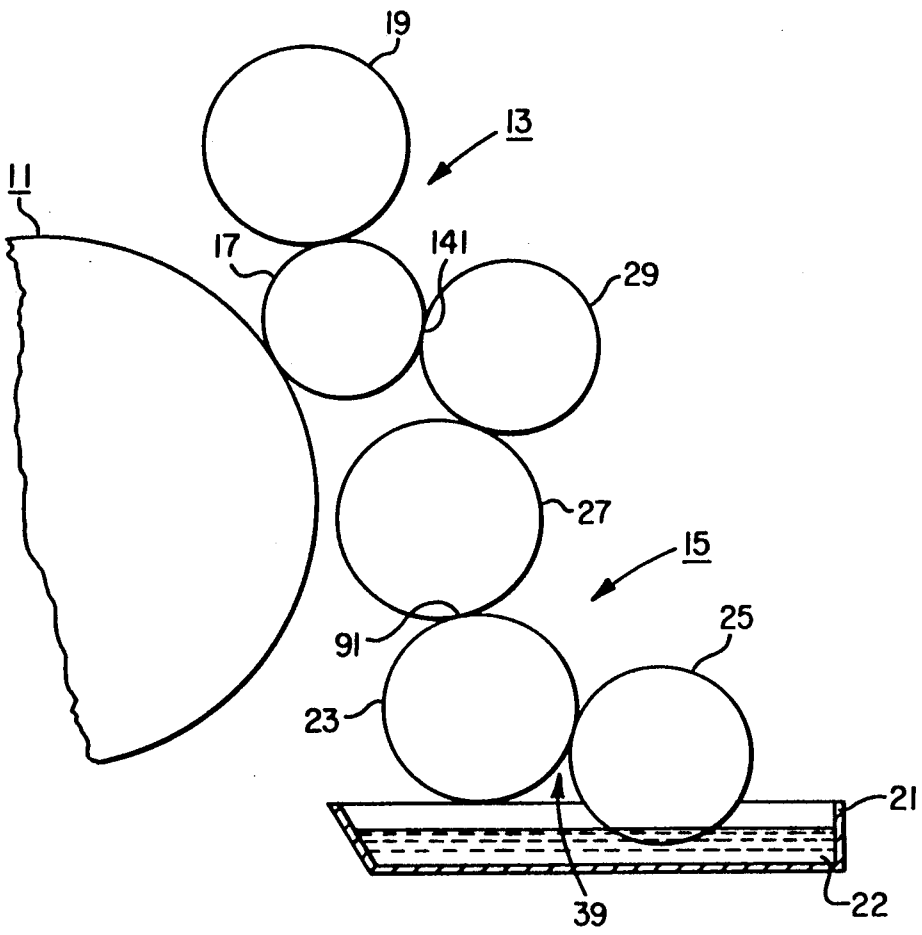
FIG. 1 is a schematic transverse cross-sectional view of the rollers of the dampening system of the present invention, in accordance with a preferred embodiment, shown in conjunction with a plate cylinder and inking rollers. The transition roller is in the first position, contacting the bridge roller.

The dampening system of the present invention is used on offset lithographic printing presses of either the web or the sheet fed type. As shown in FIG. 1, the press includes, among other things, a plate cylinder 11, an inking system 13 and a dampening system 15.

The plate cylinder 11 has a printing plate thereon, which plate has oleophilic and hydrophilic areas. The plate cylinder 11 is rotated by conventional drive means (not shown), such as motor driven gears. The inking system 13 applies ink to the printing plate on the plate cylinder, more specifically to the oleophilic areas on the printing plate. The inking system has plural ink form rollers 17 (only one of which is shown in the drawings) that contact the plate cylinder 11. In contact with the ink form rollers 17 is one or more ink vibrator rollers 19 that apply ink to the ink form rollers Using the orientation shown in FIG. 1, the plate cylinder 11 rotates counterclockwise, while the ink form rollers 17 rotate clockwise such that at the nips between the ink form rollers and the plate cylinder the direction of motion is the same.

The dampening system 15 of the present invention, which is shown in FIGS. 1-6, in accordance with a preferred embodiment, applies a water-based dampening fluid to the hydrophilic areas on the printing plate of the plate cylinder 11. The dampening system includes a pan 21, a transfer roller 23, a metering roller 25, a transition roller 27, and a bridge roller 29.

The pan 21 contains a quantity of dampening fluid 22 and is secured to dampening system frame 31 by slotted brackets 33. The brackets 33 receive pins 35 that project from the frame. The dampening system frame 31 is made up of two side walls 37 that are perpendicular to the longitudinal axes of the rollers The side walls 37 are secured together by support members (not shown) that extend parallel to the rollers. The dampening system frame 31 may either be part of the press frame or be separate from the press frame, as when the dampening system is retrofitted on an existing press.

In the embodiment shown in FIG. 1, the metering roller 25 is located in the pan 21. The metering roller 25 contacts the transfer roller 23 at a flooded nip 39. Together, the transfer roller 23 and the metering roller 25 meter the amount of dampening fluid applied to the transition roller 27 and ultimately to the plate cylinder 11. In the preferred embodiment, the transfer roller is surfaced with chrome, while the metering roller is covered with an elastomeric composition or rubber material with a durometer of 20-25 (on the Shore A. durometer scale). Alternatively, the metering roller could be chrome and the transfer roller could be composition covered. Also, a ceramic roller could be used in place of the chrome roller. Both ceramic and chrome rollers are hydrophilic, although ceramic rollers enable finer control of the metering process. The transfer roller 23 rotates counterclockwise and the metering roller 25 rotates clockwise.

Figure 2:
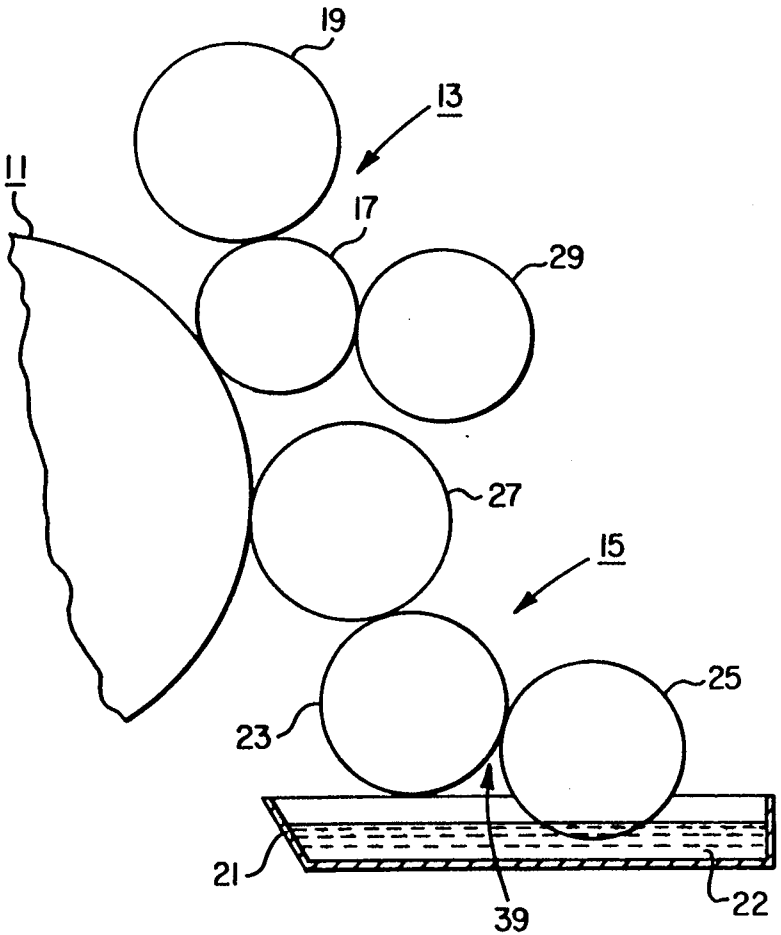
FIG. 2 is a schematic transverse cross-sectional view of the apparatus of FIG. 1, shown with the transition roller in the second position, contacting the plate cylinder.
Figure 3:
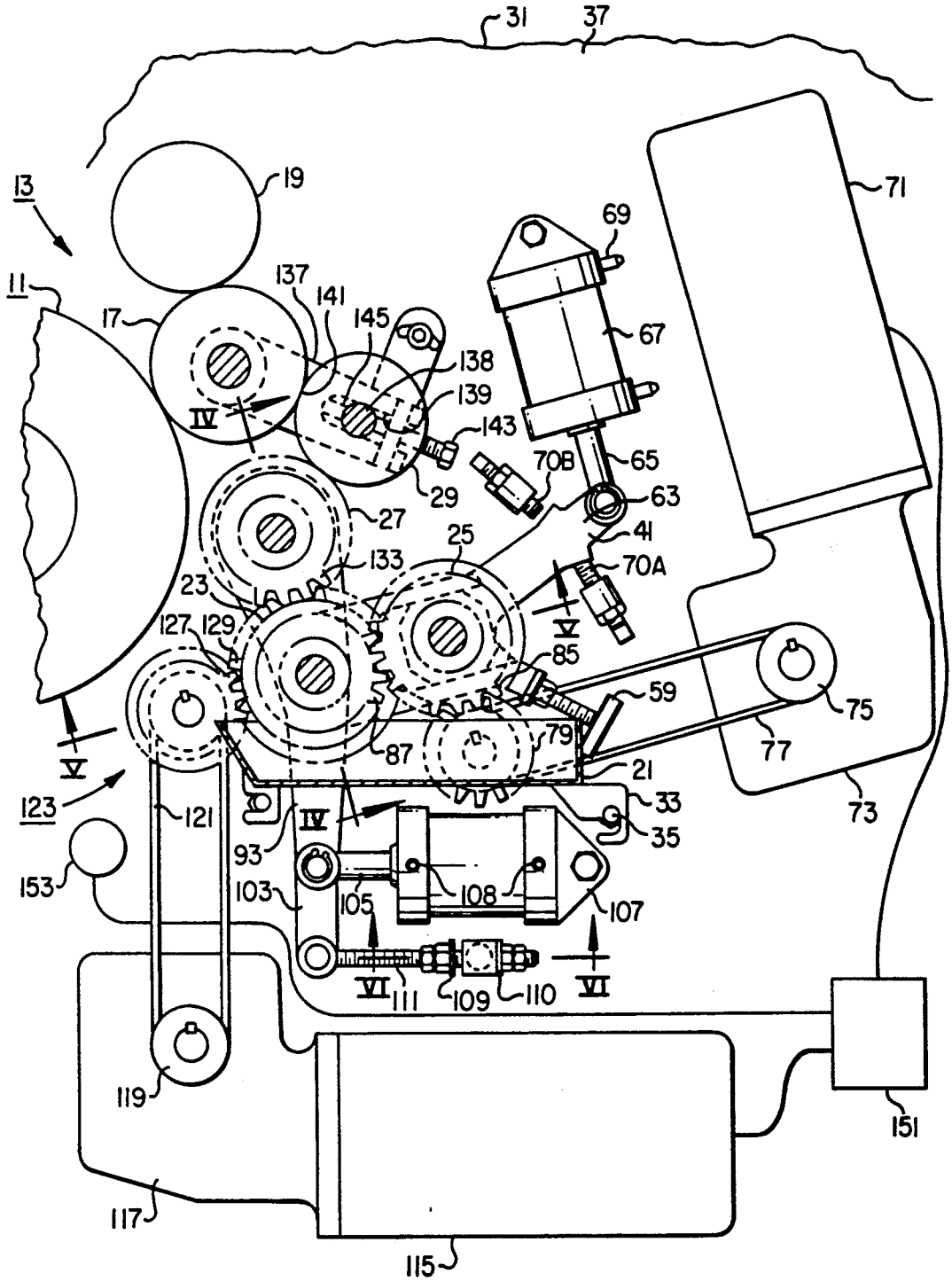
FIG. 3 is a schematic transverse cross-sectional view of the dampening system of the present invention, in accordance with another embodiment, showing the mounting assemblies for the rollers and showing the drive motors.
Figure 4:
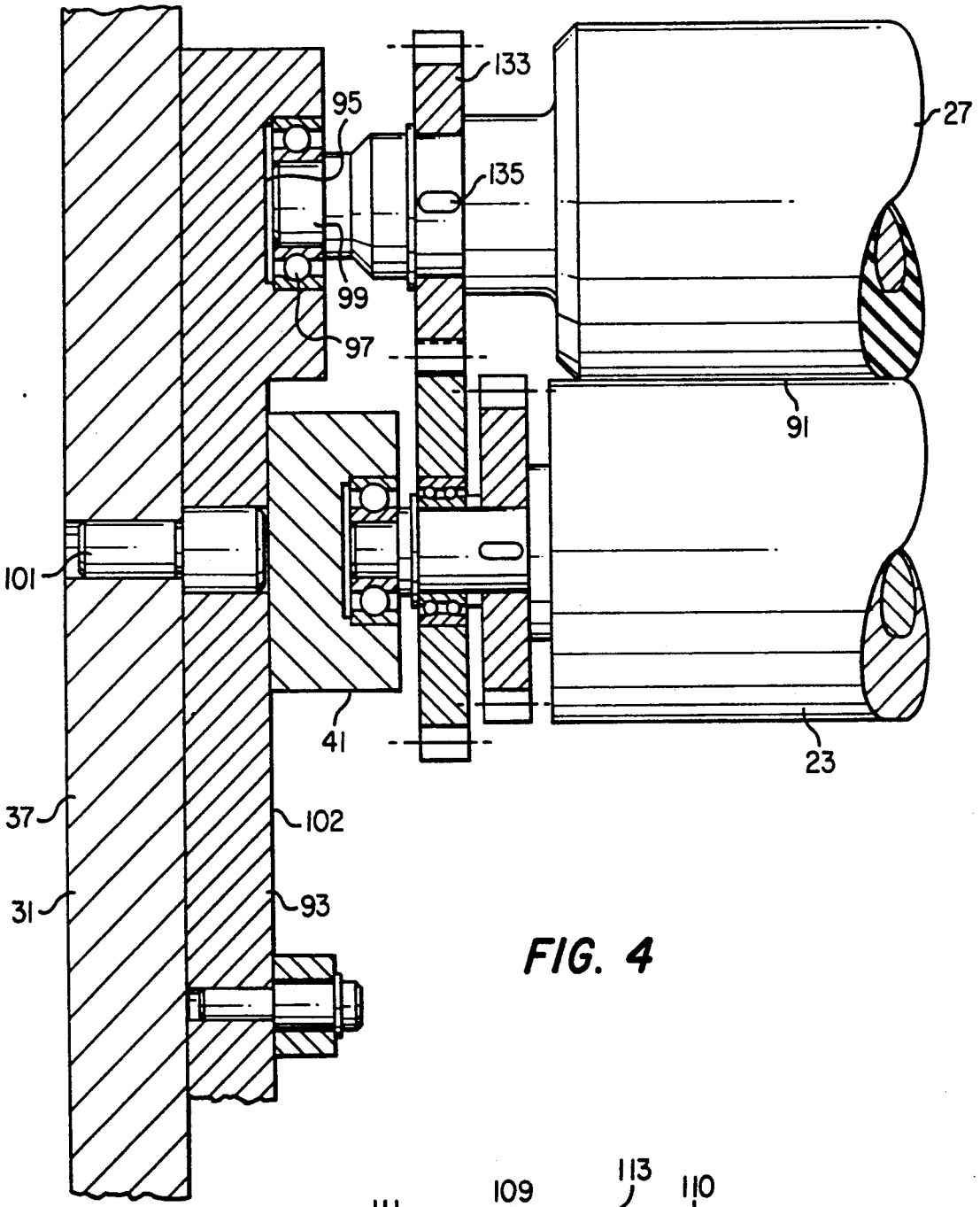
FIG. 4 is a sectional view, taken through lines IV—IV of FIG. 3.
Figure 7:
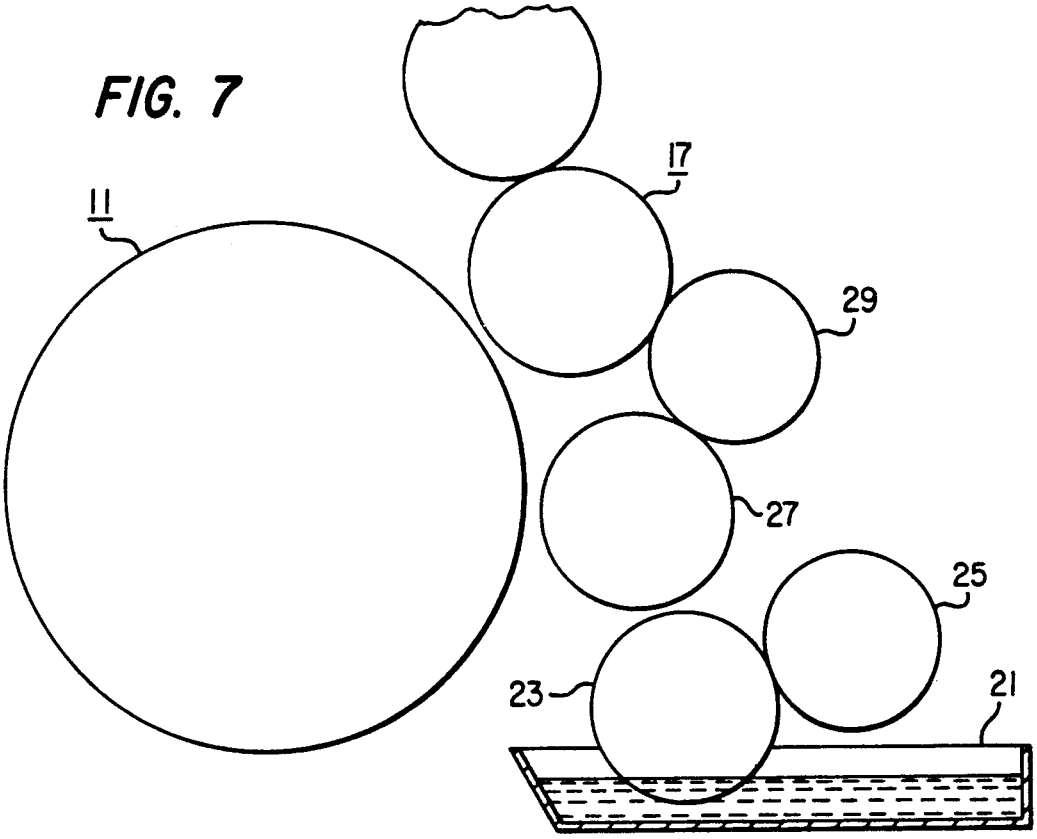
FIG. 7 is a schematic transverse cross-sectional view of the rollers of the dampening system of FIG. 3, wherein the press rollers are off of the plate cylinder for wash up of the press rollers.
Figure 8:
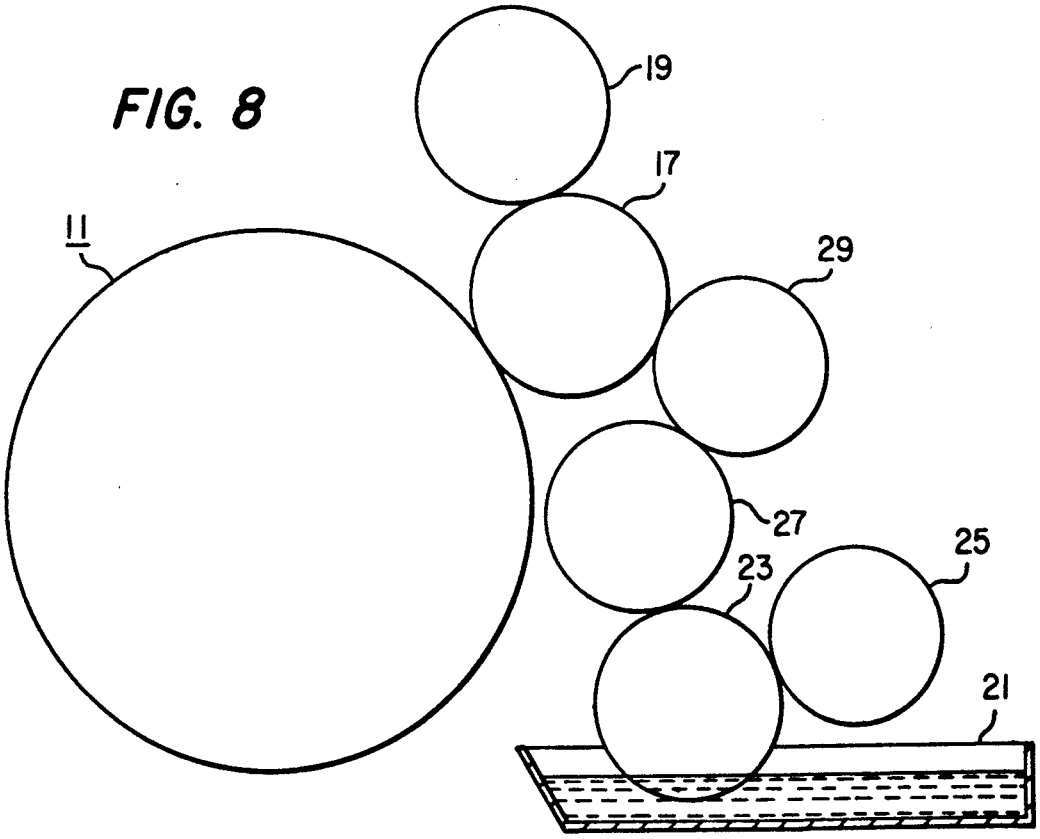
FIG. 8 is a schematic transverse cross-sectional view of the rollers of the dampening system of FIG. 3, showing the transition roller in the first position, contacting the bridge roller.

An alternate arrangement is shown in FIGS. 3, 7 and 8, wherein the transfer roller 23 is located in the pan 21 and the metering roller 25 is out of the pan. The dampening system of FIGS. 3, 7 and 8 is typically used on slow printing presses, while fast printing presses (operating at about 1000 feet per minute) typically require the dampening system of FIGS. 1 and 2.

Figure 5:
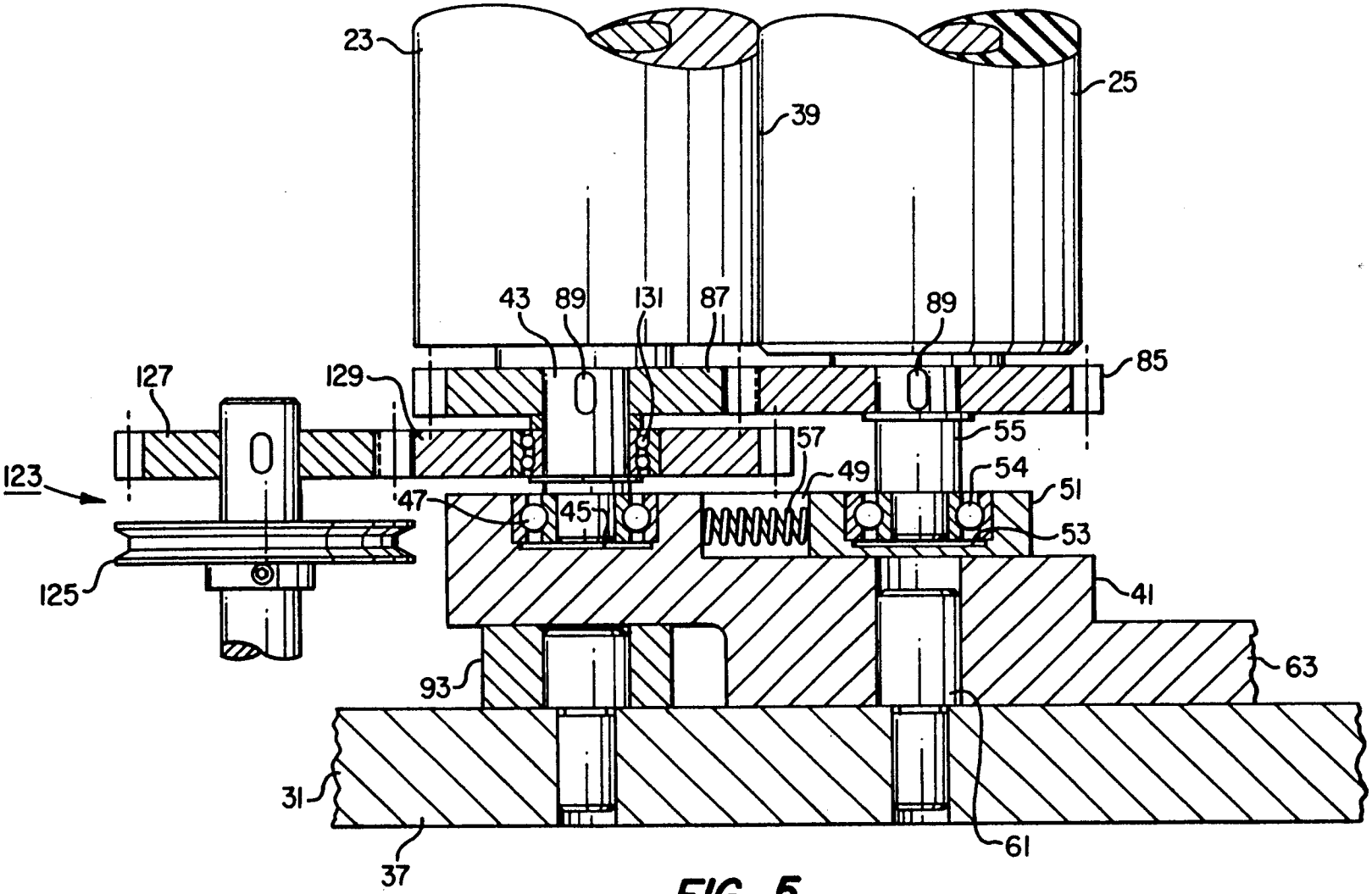
FIG. 5 is a sectional view, taken through lines V—V of FIG. 3.

The transfer and metering rollers are mounted to the frame by way of a dampening roller bracket 41 at each end (see FIGS. 3 and 5). Each roller has a shaft that extends longitudinally from each roller end. Each end of the transfer roller shaft 43 is received by a cylindrical cavity 45 in the inside surface of the respective dampening roller bracket. A bearing 47 is provided at each end of the shaft 43 to permit the rotation of the transfer roller 23. The inside surface of the dampening roller bracket also has a rectangular cavity 49 for receiving a rectangular sliding block 51. The sliding block 51 has a cylindrical cavity 53 therein for receiving bearings 54 and an end of the metering roller shaft 55. The sliding block 51 thus allows the metering roller 25 to move closer to or further from the transfer roller 23, wherein the nip pressure at the flooded nip 39 can be adjusted. A helical coil spring 57 bears on the sliding block 51, exerting a force away from the transfer roller 23. Force in the opposite direction is provided by an adjusting screw 59 that engages threads on the dampening roller bracket 41. The adjusting screw 59 is angled about 45 degrees off of the axis of motion of the sliding block so as to provide for more resolution in controlling the pressures between the rollers at the flooded nip 9. The adjusting screw 59 bears on a beveled surface of the sliding block 51. An adjusting screw 59 is provided on each end of the metering roller. The head of the adjusting screw 59 is accessible to a press operator. The metering roller 25 is mounted to the dampening roller bracket 41 so as to permit skewing of the longitudinal axis of the metering roller with respect to the longitudinal axis of the transfer roller 23, in accordance with conventional practice.

Each dampening roller bracket 41 is pivotally coupled to the respective side wall 37 of the frame by a pivot pin 61 (see FIG. 5). This allows the transfer roller 23 to be pivoted toward the pan 21 during clean up operations. The pivoting motion separates the transfer roller 23 from the transition roller 27 (as shown in FIG. 7), thereby preventing cleaning fluid in the inking system from reaching the reservoir of dampening fluid in the pan 21. The pin 61 is coaxial to the shaft 55 of the metering roller 25 so that as the dampening roller bracket pivots, it pivots about the metering roller. Each dampening roller bracket 41 has an arm 63 that extends generally away from the plate cylinder. The end of each arm 63 is coupled to the shaft 65 of an air cylinder 67. Each air cylinder 67 is coupled to the respective frame side wall 37. The air cylinder 67 causes the dampening roller bracket 41 to pivot by extending or retracting the air cylinder shaft 65. A conventional compressed air supply (not shown) is used to provide compressed air to the air cylinder at nozzles 69 on the air cylinder 67. The extent of pivoting motion of the bracket is limited by stops 70A, 70B, one on each side of the arm. Each stop is a threaded shaft that engages interior threads in a block. The blocks are mounted to the frame side wall.

Figure 14:
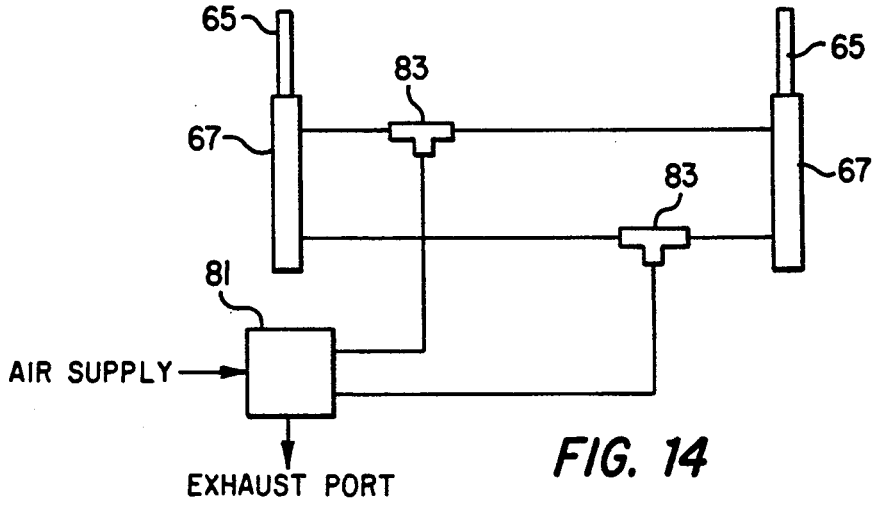
FIG. 14 is a schematic diagram of one of the pneumatic control systems for the air cylinders.

The direction of the motion of the shaft 65 is controlled by a conventional, commercially available four way solenoid valve 81, as shown in FIG. 14. The air supply is connected to the valve 81, which has an exhaust port. The two output ports of the valve 81 are connected to tees 83 that split the air from the valve 81 to each air cylinder 67.

The transfer and metering rollers 23, 25 are rotated by a drive motor 71. The motor 71, which is mounted onto one of the frame side walls 37, has a speed reducer 73 and an output sheave 75. The output sheave 75 is coupled by a drive belt 77 to a drive assembly 79. The drive assembly 79 includes a sheave and a spur gear that are coupled together and mounted to the frame side wall 37. The drive assembly 79 gear is meshed with a gear 85 on the metering roller 25. The metering roller gear 85 is meshed with a gear 87 on the transfer roller 23. The metering roller gear 85 and the transfer roller gear 87 are rotationally coupled to their respective shafts by keys 89.

As the drive motor 71 turns the output sheave 75, the belt 77 rotates and turns the drive assembly 79. This correspondingly rotates the gears 85, 87 to rotate the rollers 23, 25. In the embodiment of FIGS. 1 and 2, the transfer roller 23 is rotated at a faster surface speed than the metering roller 25. This is accomplished by an appropriate gear ratio between the spur gears 85, 87.

Figure 6:
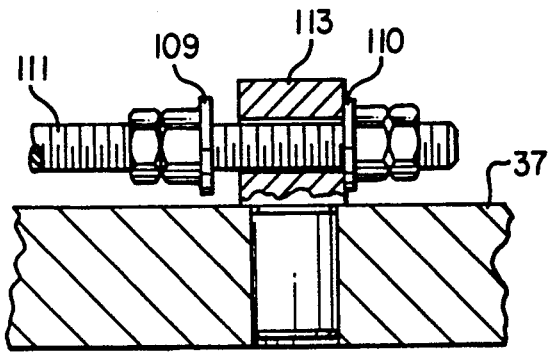
FIG. 6 is a sectional view, taken through lines VI—VI of FIG. 3.

The transition roller 27 contacts the transfer roller 23 at a nip 91 that is located downstream from the flooded nip 39. The transition roller 27 is covered with an elastomeric composition or rubber material having a durometer of 20–35. In the preferred embodiment, the outside diameter of the transition roller is 25–100% larger than the outside diameter of the ink form rollers 17 so as to provide a stiff roller 27. The transition roller 27 is mounted to the frame by transition brackets 93 (see FIGS. 3 and 4). There is a transition bracket 93 on each end of the transition roller. Each transition bracket 93 has a cylindrical cavity 95 for receiving bearings 97 and the respective end of the transition roller shaft 99. Each transition bracket 93 is interposed between the respective metering bracket 41 and the frame side wall 37 where it is pivotally coupled to the side wall by a pin 101. The respective pin 101 is coaxial with the longitudinal axis of the transfer roller 23 so that the transition roller 27 pivots about the transfer roller. The respective end portion of the metering bracket 41 that supports the transfer roller is free to slide on the inside surface 102 of the transition bracket 93. Each transition bracket 93 extends from the respective pivot pin 101 in a direction that is generally opposite to its transition roller end so as to form an actuation arm 103. Each actuation arm 103 is coupled to the shaft 105 of an air cylinder 107, which air cylinders are coupled to the respective frame side walls 37. By extending or retracting the air cylinder shaft 105, the transition roller 27 is moved between first and second positions. The compressed air supply is connected to nozzles 108 on the air cylinder 107. The extent of pivoting motion by each transition bracket 93 is limited by stops 109, 110 on a stop shaft 111. The stop shaft 111 is pivotally coupled to the arm 103 of the transition bracket 93 and extends through a block 113 as shown in FIG. 6. The block 113 is coupled to the respective frame side wall 37. The stop shaft 111 is free to slide within the block 113. The stops are nuts 109, 110 that are positioned on the stop shaft 111 on each side of the block 113. As the transition bracket pivots, the nuts 109, 110 contact the block 113 and limit the extent of motion on the bracket.

The transition roller 27 is rotated independently of the other press rollers by a separate drive motor 115. In the orientation shown in FIGS. 1–3, the transition roller rotates clockwise. The motor 115 is mounted to the frame 31 on one side and has a speed reducer 117 and an output sheave 119. The output sheave 119 is coupled to a drive assembly 123 by a belt 121. The drive assembly 123 includes a sheave 125 (see FIG. 5) and a spur gear 127 that are coupled together and mounted to the frame 31. The gear 127 is meshed with an intermediate gear 129 mounted on the shaft 43 of the transfer roller 23. The intermediate gear 129 is bearing 131 mounted onto the shaft 43 so as to rotate independently of the transfer roller. The intermediate gear 129 is meshed with a transition roller gear 133, which is coupled to the shaft 99 by a key 135.

As the motor 115 turns its output sheave 119, the belt 121 rotates and turns the drive assembly sheave 125. This correspondingly rotates the drive assembly gear 127, the intermediate gear 129 and the transition roller gear 133, wherein the transition roller 27 is rotated.

The transition roller can be an oscillating roller, wherein it oscillates along its longitudinal axis. Conventional techniques are used to oscillate the transition roller.

In the preferred embodiment, a bridge roller 29 is provided to bridge between the transition roller 27 and one of the inking rollers. Thus, when the transition roller is in the first position, the transition roller is rotatively coupled to the inking form roller 17. A bridge roller will typically be required in most presses because of the physical configuration of the presses. However, in some small presses, a bridge roller may not be required.

The bridge roller 29 contacts the adjacent ink form roller 17. The bridge roller 29 can have a variety of surfaces and durometers. The bridge roller can have a covering of rubber or some other elastomeric composition, hard plastic, nylon or copper plating, to name a few materials. The covering is ink receptive.

Referring to FIG. 3, the bridge roller 29 is rotatably mounted to the frame by a bridge bracket 137 at each end. The bridge roller 29 rotates about a dead shaft. The shaft ends 138 are received by a slot 139 in each bridge bracket 137 The slot 139 allows the bridge roller 29 to be moved either closer to or farther from the adjacent ink form roller 17, to adjust the pressure at the nip 141. An adjusting screw 143 is provided to force the bridge roller 29 towards the ink form roller 17, while an opposing spring 145 exerts force away from the ink form roller.

The bridge roller 29 is friction driven by the adjacent ink form roller 17 and the transition roller 27. The ink form rollers are rotated at the same surface speed as the plate cylinder, while the transition roller is rotated slower than the surface speed of the plate cylinder. The bridge roller tends to follow the faster roller (the ink form roller). The bridge roller 29 can be of the oscillating type, where the roller oscillates back and forth along its longitudinal axis, or of the non-oscillating type.

The adjustment of the nip pressure between the various rollers will now be discussed. With the exception of the flooded nip, the nip pressures are typically adjusted immediately after the installation of the dampening system onto a printing press. The pressure between the transfer roller 23 and the transition roller 27 is set by the lowermost stop 70A on the dampening roller bracket 41. The pressure between the transition roller 27 and the plate cylinder 11 is set by the stop 109 on the transition bracket 93. The pressure between the transition roller 27 and the bridge roller 29 is set by the stop 110 on the transition bracket. The pressure between the bridge roller 29 and the first ink form roller 17 is set by the bridge adjustment screws 143 on each end.

The pressure between the transfer roller 23 and the metering roller 25 is adjusted by the adjustment screws 59. The pressure is adjusted in accordance with conventional practice; namely, the pressure is relieved to allow a large quantity of dampening fluid through the flooded nip 39. Then, the pressure is increased until a smooth, uniform sheet of fluid is on the transfer roller 23 after the nip.

The operation of the dampening system 15 of the present invention will now be described. The dampening system 15 applies dampening fluid to the plate cylinder 11 as the plate cylinder rotates. The ink form rollers 17 apply ink to the plate cylinder To start the dampening system 15 and the press, the operator starts the motor 71 to wet the dampening rollers 23, 25. Then, the press is started to as to rotate the plate cylinder and the inking rollers. Then, the form rollers are brought into contact with the plate cylinder and the transfer roller 23 is brought into contact with the transition roller 27.

During the operation of the press, the transition roller 27 is able to move between first and second positions. In the first position, shown in FIG. 1, the transition roller 27 contacts the bridge roller 29 and does not contact the plate cylinder. Thus, the dampening fluid is applied to the plate cylinder by way of the ink form rollers 17. In the second position, shown in FIG. 2, the transition roller 27 breaks contact with the bridge roller 29 and contacts the plate cylinder 11. The dampening fluid is applied to the plate cylinder by the transition roller 11.

The dampening fluid 22 is typically made up of primarily water, with conventional chemicals added thereto. The chemicals are commercially available and include a weak acid and gum arabic. In prior art dampening systems, isopropyl alcohol has been used as a wetting agent to assist in the mixing of the water-based dampening fluid with the oil-based ink on the roller surfaces. In fact, some prior art dampening systems practically require the use of alcohol for proper operation. Other types of alcohol, such as methanol or ethanol, can be used in the dampening fluid, but they are difficult to obtain and are more expensive than isopropyl alcohol. Prior art dampening fluid may contain up to 25% of alcohol by volume. One of the attributes of alcohol is that it evaporates quickly and does not interfere with the printing process. Unfortunately, the evaporation of alcohol pollutes the air in the press room, causing medical and fire hazards Isopropyl alcohol is carcinogenic and is highly flammable Alcohol substitutes can be used in lieu of alcohol. However, substitutes are not as effective in assisting the mixing of dampening fluid and ink as is alcohol. Better control of the metering process is achieved with alcohol than with alcohol substitutes. When alcohol substitutes are used, the dampening fluid typically contains about 1% of substitutes by volume. Alcohol substitutes leave a glaze on the rollers, which must be periodically cleaned off, a time consuming chore.

With the dampening system 15 of the present invention, no alcohol is needed in the dampening fluid because the dampening fluid is mixed into the ink by the time the dampening fluid is applied to the plate cylinder. Alcohol substitutes may have to be added to the dampening fluid when printing with some inks. When the transition roller 27 is in the first position, the dampening fluid must traverse several nips between rollers and enter the inking system before being applied to the plate cylinder In addition, the transition roller 27 is rotating at a slower surface speed than the plate cylinder 11 and at a faster surface speed than the transfer roller 23. The transfer roller 23 is rotated at a faster surface speed than the metering roller 25. This produces a wiping action at those nips having differential speeds that assists in mixing the dampening fluid with the ink. Furthermore, the use of a relatively soft transition roller (20–35 durometer) to provide relatively large pressure indents with the adjacent rollers and the use of a relatively large diameter transition roller to provide stiffness allows better control in metering the amount of dampening fluid to the plate cylinder.

The speed of the transition roller 27 can be adjusted independently of the speed of the other rollers in the dampening system and in the press, because the transition roller is driven by a separate motor. The transition roller is normally rotated at a slower surface speed than the surface speed of the plate cylinder and the ink form rollers When the transition roller is in the first position, the slower speed assists in mixing the dampening fluid with the ink. When the transition roller is in the second position, the slow speed cleans hickeys off of the plate cylinder 11. The independently controlled speed of the transition roller 27 allows the speed to be varied to find the optimum conditions for various types of printing jobs Although the transition roller is driven more slowly than the plate cylinder, this need not be the case. The transition roller can be driven at the same speed as the plate cylinder.

During the operation of the press, hickeys will begin to appear on the plate cylinder 11. The number of hickeys increases as the press continues to operate without cleaning of the plate cylinder. The hickeys reduce the quality of print on the paper running through the press.

With the dampening system 15 of the present invention, the operator can, during the operation of the press, clean the hickeys off of the plate cylinder. The operator moves the transition roller 27 from the first position to the second position by actuating the air cylinders 107. In the second position, the transition roller 27 contacts the plate cylinder and the speed of the transition roller is maintained at a slower surface speed than the surface speed of the plate cylinder This speed differential results in a wiping action of the printing plate on the plate cylinder, which cleans any hickeys off of the printing plate The hickeys are picked up by the transition roller 27 and carried to the transfer roller 23 and then to the pan 21. The dampening fluid 22 in the pan is circulated through a filter in accordance with conventional press practice This filtering process removes the hickeys from the dampening fluid. The transition roller 27 is kept in the second position for a few revolutions of the plate cylinder 11 to clean off the hickeys, wherein the operator actuates the air cylinder 107 to move the transition roller back to the first position.

Because the transition roller 27, when in the second position, does not contact the bridge roller 29, hickeys on the transition roller are prevented from moving to the bridge roller and into the inking system. The prior art removes hickeys from the plate cylinder, only to put them in the inking system where they can be reapplied to the plate cylinder. With the dampening system of the present invention, however, once the hickeys are cleaned off of the plate cylinder, they are removed from the press through the dampening fluid as described above, thereby preventing reapplication of the hickeys to the plate cylinder.

Furthermore, because the differentially rotating transition roller contacts the plate cylinder for only a few revolutions, plate wear is greatly reduced. The prior art uses form rollers that are in constant contact with the plate cylinder and that rotate at a slower speed than the plate cylinder. This produces excessive wear on the printing plate.

During startup of the press, the transition roller 27 can be set in the second position in order to predampen the plate cylinder and rapidly achieve the desired ink-water balance. When a press is started up, it takes a finite period of time for the dampening fluid to reach the plate cylinder. This length of time is increased when the transition roller is in the first position, because the dampening fluid must traverse a relatively long path. If there is not a sufficient amount of dampening fluid being applied to the plate cylinder, then the ink form rollers will apply ink to the nonprint areas. The plate cylinder is thus "scummed" with ink. The plate cylinder can be predampened by setting the transition roller in the second position, wherein dampening fluid is applied to the plate cylinder. After a few revolutions, the plate cylinder is dampened sufficiently and the transition roller is moved to the first position.

Figure 9:
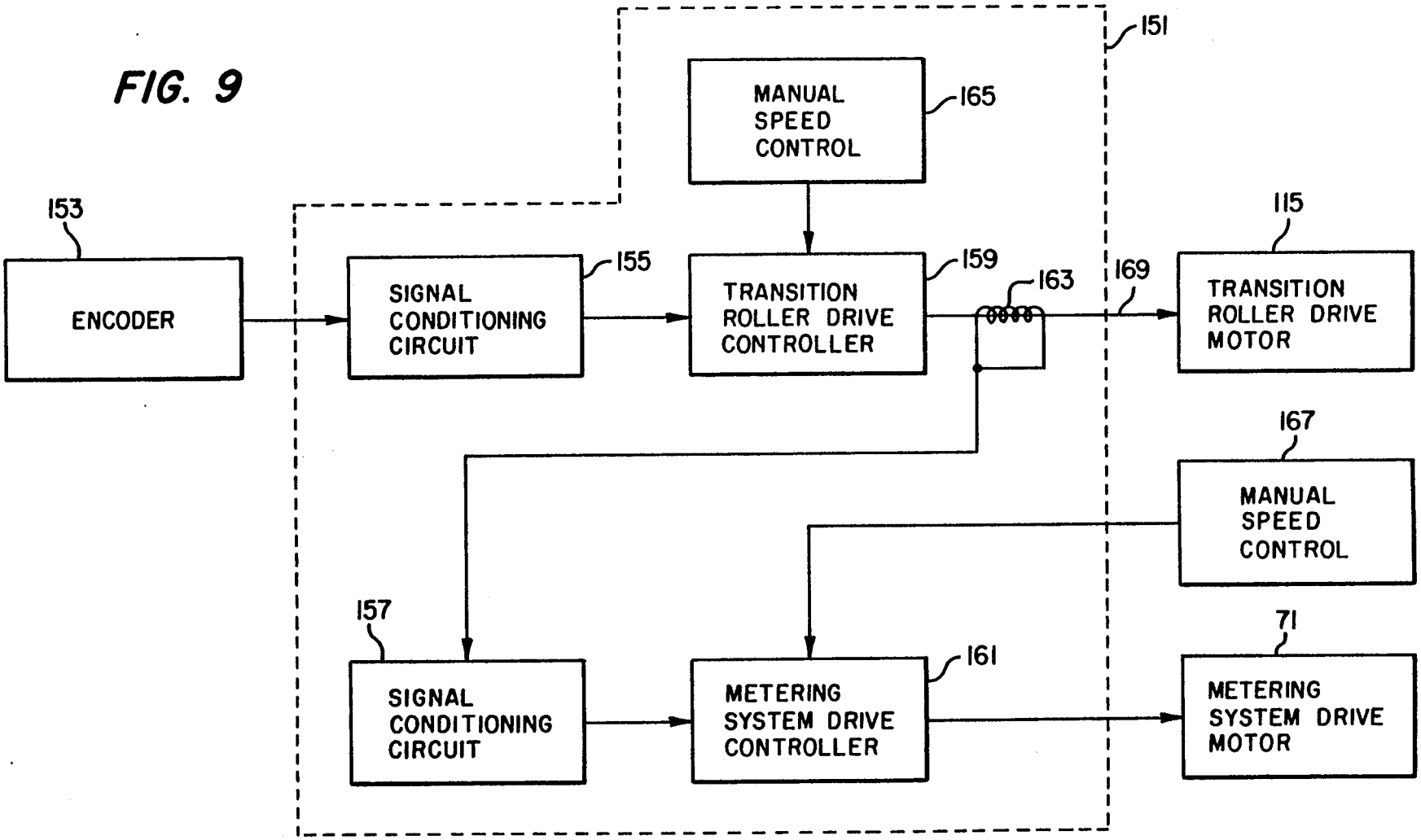
FIG. 9 is a block diagram showing the controller used with the dampening systems of FIGS. 1-8.

The dampening system of the present invention is also provided with a controller 151 for automatically adjusting the amount of dampening fluid that is applied to the plate cylinder so as to maintain the proper ink-water balance (or ink-dampening fluid balance). The controller 151 regulates the amount of dampening fluid that is applied to the plate cylinder by controlling the speed of the transition, transfer and metering rollers 27, 23, 25. The controller 151 maintains the transition roller 27 rotating near a surface speed referenced with respect to the surface speed of the plate cylinder while causing the speed of the transition roller 27 to follow the changes in the speed of the plate cylinder 11. If the plate cylinder speeds up, then the transition roller will follow and correspondingly speed up. The speed of the transfer and metering rollers is dependent on the resistance to rotation encountered by the transition roller. If the transition roller encounters a high resistance to rotation, then the transfer and metering rollers are speeded up so as to deliver additional dampening fluid to the transition roller, thereby lowering the resistance to rotation to a normal level Referring to FIG. 9, the controller 151 includes a first sensor 153, first and second signal conditioning circuits 155, 157, drive controllers 159, 161 for the transition roller and the metering system, a second sensor 163, and first and second manual speed controls 165, 167.

The first sensor 153 senses the speed of the press by determining the speed of the plate cylinder 11. The plate cylinder is driven by the press motor independently of the transfer and metering rollers 23, 25 and the transition roller 27. The plate cylinder is geared to the ink vibrator rollers so that the press speed can be obtained from any one of these rollers. In the preferred embodiment, the first sensor is a conventional, commercially available encoder 153 that is mounted onto the press frame so as to pick up the speed of the plate cylinder. The encoder 153 produces a train of pulses, the frequency of which is determined by the speed of the press. The input of the first signal conditioning circuit 155 is connected to the output of the encoder 153. The first signal conditioning circuit 155 includes a frequency-to-voltage converter that converts the frequency changes in the pulse train produced by the encoder 153 into voltage changes that are acceptable by the drive controller 159. The first signal conditioning circuit 155 has amplifiers to amplify the voltage signals, which are then applied to the input of the transition roller drive controller 159. The output of the transition roller drive controller 159 is connected to the transition roller drive motor 115.

The drive controllers 159, 161 are conventional, commercially available units that are used to drive the motors 115, 71. In the preferred embodiments, the drive controllers are U.S. Motors, Model C540 units. Each drive controller 159, 161 contains a follower circuit that produces an output to the respective drive motor 115, 71, which output follows the voltage inputs from the respective conditioning circuits 155, 157. Each drive controller 159, 161 has a manual speed control that is associated therewith In the preferred embodiment, the manual speed controls are potentiometers that adjust the ratio between the input and the output of a drive controller. For example, the transition roller 27 could be driven at 1:1 with the plate cylinder 11, or it could be driven at a slower speed, 0.85:1. The first manual speed control 165 is typically set at the factory or upon installation of the dampening system onto the press. The drive controllers produce a regulated output signal to the motors so as to drive the respective motors at a constant speed for a fixed input. This is achieved by way of voltage and/or current sensing circuits in the drive controllers that sense any change in voltage or current caused by load changes on the respective motor.

If the input to the drive controller 159, 161 changes, the output will follow and change accordingly. Thus, the speed of the transition roller 27 follows the changes in speed of the plate cylinder 11. For example, if the plate cylinder 11 is rotating at 500 feet per minute, and the first manual speed control 165 is set so that the transition roller 27 runs 15% slower than the plate cylinder, then the transition roller 27 will rotate at about 425 feet per minute. If, the plate cylinder 11 slows down to some speed below 500 feet per minute, then the drive controller 159 causes the transition roller 27 to correspondingly slow down below 425 feet per minute. Likewise, as the plate cylinder speeds up, the transition roller will correspondingly speed up.

The speed of the transfer and metering rollers 23, 25 are controlled by the metering system drive controller 161. The output of the metering system drive controller 161 is connected to the drive motor 71. One of the inputs of the drive controller 161 is connected to the output of the second signal conditioning circuit 157, which has an input connected to the second sensor 163. In the preferred embodiment, the second sensor 163 is a current detector electrically coupled to the conductor 169 between the transition roller drive controller 159 and the drive motor 115. The other input of the metering system drive controller 161 is connected to the second manual speed control 167, which can be adjusted by the operator during press operation.

The metering system drive controller 161 regulates the speed of the transfer and metering rollers 23, 25 according to the load on the transition roller 27. If the plate cylinder speed is constant, then the transition roller speed is also constant. Therefore, any change on the load on the transition roller will require a change in current provided to the motor 115 by the drive controller 159. These current changes are detected by the current detector 163. The second signal conditioning circuit 157, which is similar to the first signal conditioning circuit 155, converts the signal from the current detector into voltages that are acceptable to the drive controller 161. The drive controller 161 produces an output to the motor 71 that follows the changes in the load of the transition roller motor 115.

The press operator provides a baseline speed for the transfer and metering rollers 23, 25 by way of the second manual speed control 167. This baseline speed corresponds to the desired ink-water balance and is typically determined empirically at the beginning of a press run. During the operation of the press and as the load on the transition roller changes, the speed of the transfer and metering rollers will correspondingly change around the baseline speed.

The load on the transition roller 27 is determined by the viscosity of the fluid on the transition roller. Ink is more viscous than dampening fluid. As the amount of dampening fluid relative to the ink on the transition roller increases, the load on the transition roller 27 will decrease, and the current energizing the motor 115 will decrease in order to maintain the transition roller at constant speed. This decrease in current is detected by the current detector 163, which causes the drive controller 161 to reduce its output, wherein the speed of the transfer and metering rollers is decreased This slowdown results in a decrease in the amount of dampening fluid being pulled up from the pan 21 and applied to the transition roller The reduction of dampening fluid to the transition roller 27 will increase the load on the motor 115, wherein the system goes back to equilibrium. Thus, the desired ink-water balance is maintained.

Figure 10:
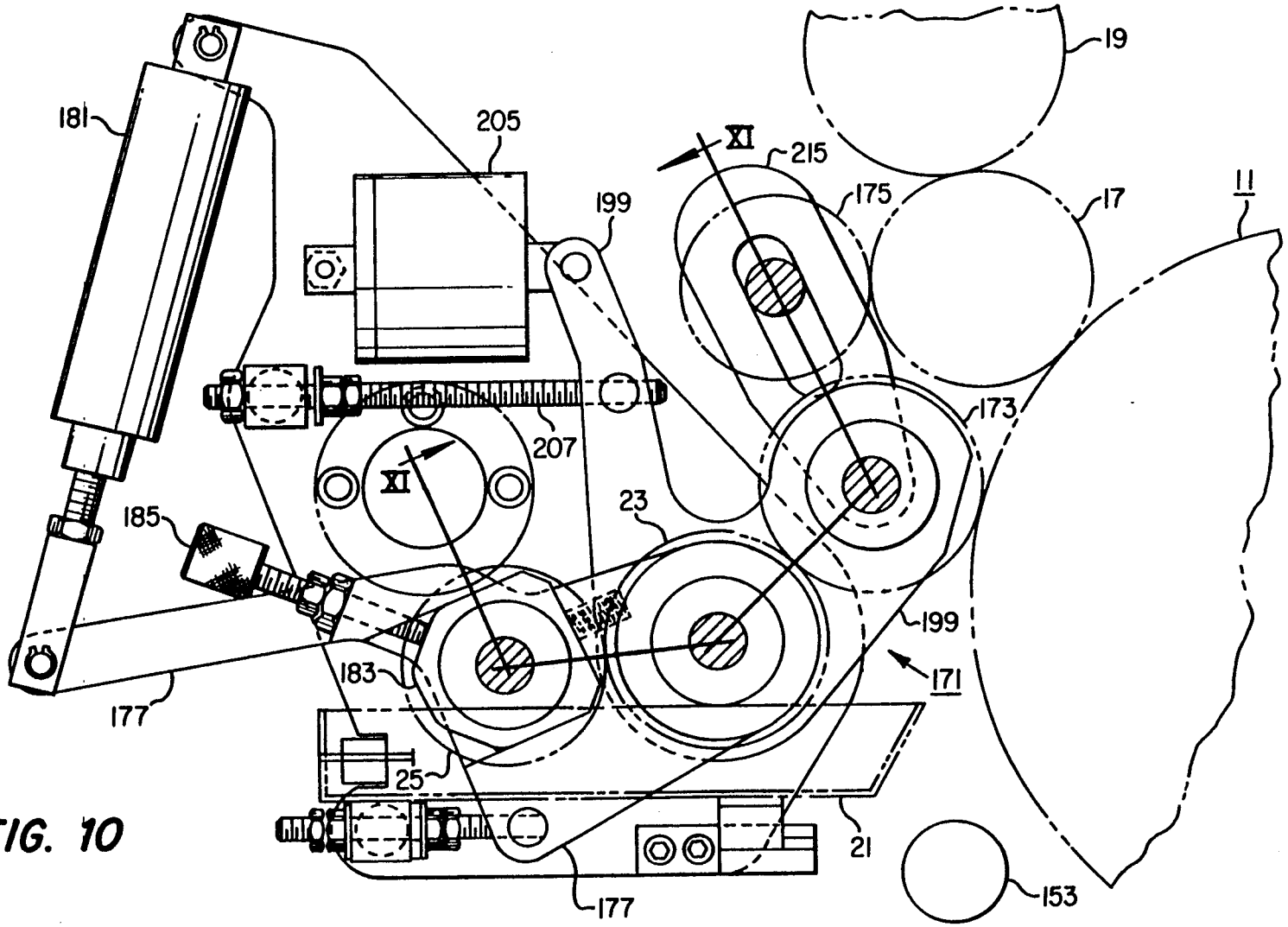
FIG. 10 is a schematic transverse cross-sectional view of the dampening system of the present invention, in accordance with still another embodiment.
Figure 11:
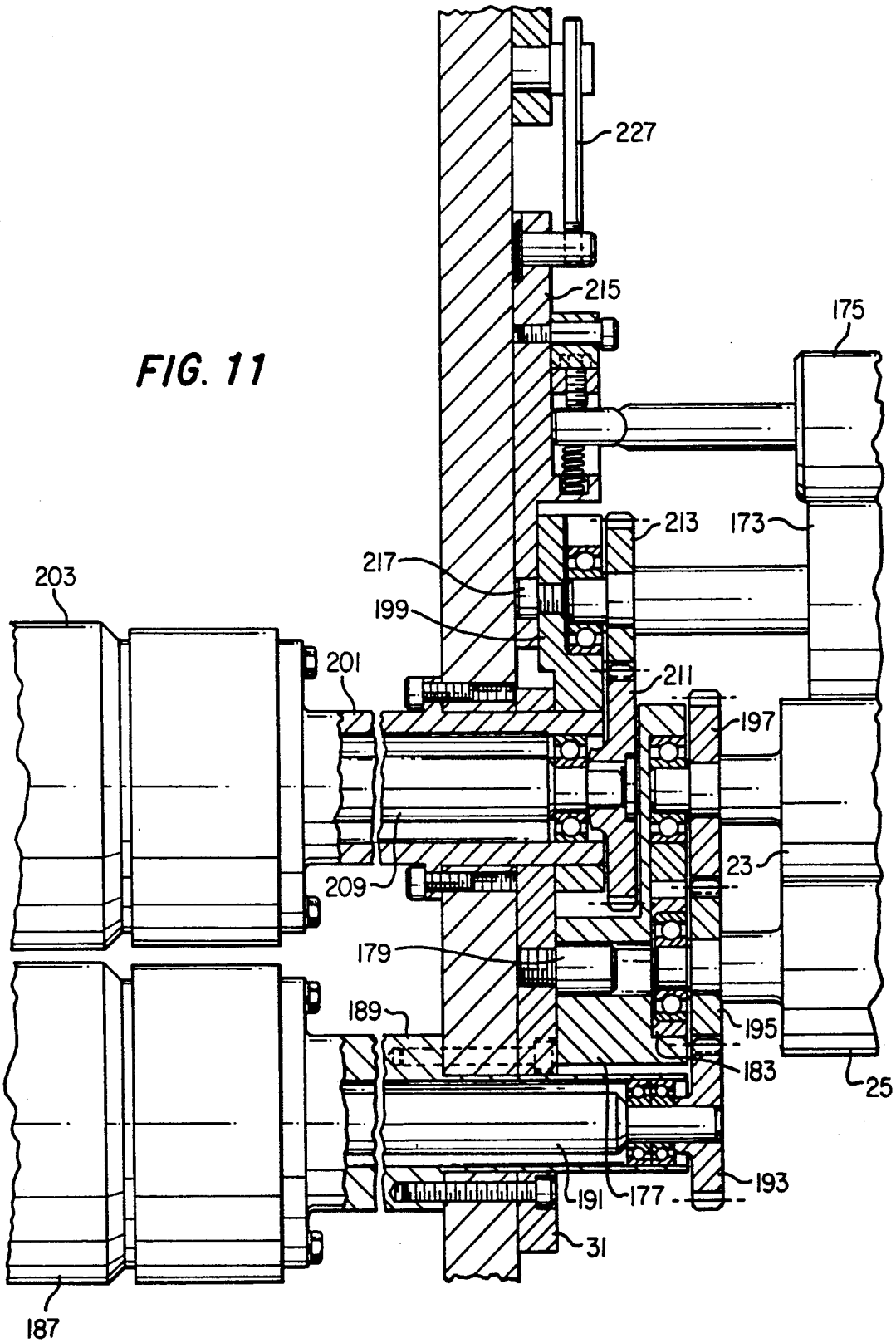
FIG. 11 is a schematic longitudinal cross-sectional view of the dampening system, taken along lines XI—XI of FIG. 10.
Figure 12:
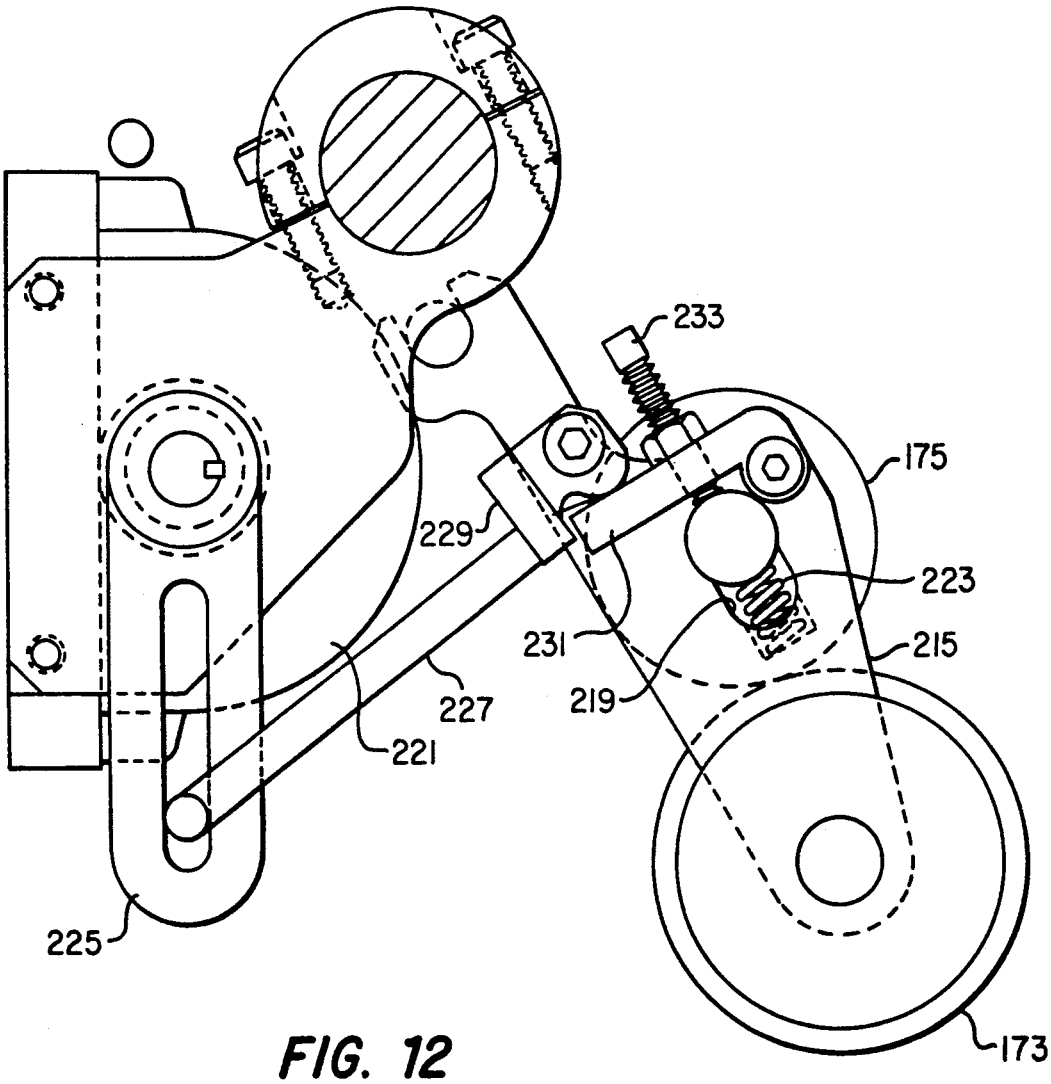
FIG. 12 is a schematic view showing the actuation mechanism, of the dampening system of FIG. 10, for moving the bridge roller.

In FIGS. 10-12, there is shown the dampening system 171 of the present invention, in accordance with another embodiment. The dampening system 171 has a pan 21, transfer and metering rollers 23, 25, a transition roller 173 and a bridge roller 175. The dampening system 171 is similar to the dampening system 15 of FIGS. 1-8 in that the transition roller 173 moves between first and second positions. In addition, the bridge roller 175 moves between third and fourth positions.

Referring to FIGS. 10 and 11, the transfer and metering rollers 23, 25 are rotatably mounted to the dampening system frame 31 by way of a dampening roller bracket 177 at each end of the rollers. Each dampening roller bracket 177 is mounted to the frame 31 so as to pivot about a pin 179. As shown in FIG. 10, during the operation of the dampening system, the transfer roller 23 contacts the transition roller 173. During cleanup operations, the transfer roller is pivoted away from the transition roller. An air cylinder 181 on each end provides the actuating means for pivoting the dampening roller bracket 177. The ends of the metering roller 25 are received by respective sliding blocks 183, which are in turn slidably mounted into the bracket 177. The sliding block 183 allow the adjustment of the pressure between the transfer and metering rollers. Adjusting screws 185 provide opposing force against a spring to adjust the position of the sliding blocks.

A drive motor 187 is mounted to the press frame by way of a sleeve 189. The motor 187 has a gear reducer, which drives a shaft 191 inside of the sleeve 189. The end of the shaft is coupled to a gear 193, that drives gears 195, 197 on the metering and transfer rollers 25, 23.

The transition roller 173 is rotatably mounted to the dampening system frame 31 by way of a transition bracket 199 at each end of the roller. The transition brackets 199 are pivotally coupled to the frame 31. On the motor side of the frame, the respective transition bracket 199 is pivotable about a sleeve 201, that extends from the press so as to support a drive motor 203. The transition roller 173 is pivotable between first and second positions. In the first position, the transition roller 173 is not in contact with the plate cylinder 11, so that there is a gap between the plate cylinder 11 and the transition roller 173. In the second position, the transition roller 173 is in contact with the plate cylinder 11. An air cylinder 205 is provided on each end to pivot the bracket 199 and the transition roller 173. A stop shaft 207 with stops is coupled to the bracket 199, so as to limit the pivoting motion of the bracket. The drive motor 203 is mounted to the press frame 31 by way of the sleeve 201. The motor 203 has a gear reducer, which drives the shaft 209 located inside of the sleeve 201. The end of the shaft 209 is coupled to a gear 211, which drives the gear 213 on the end of the transition roller 173.

The bridge roller 175 is rotatively mounted to a bridge bracket 215 on each of its ends. The bridge roller 175 is friction driven by the adjacent contacting rollers. Each bridge bracket 215 is pivotally coupled to the respective transition bracket 199 by way of a pivot pin 217. The pivot pin 217 is coaxial with the longitudinal axis of the transition roller 173. This pivoting arrangement with the transition bracket 199 allows the bridge roller 175 to correspondingly move with the transition roller, as the transition roller moves between the first and second positions. When the bridge roller is in contact with transition roller, the bridge roller maintains contact even though the transition roller moves between its first and second positions.

Each bridge bracket 215 has a slot 219 therein for receiving an end of the bridge roller 175. The slot 219 allows the bridge roller 175 to move between third and fourth positions. In the third position, the bridge roller 175 is in contact with the transition roller 173 (see FIG. 12) and in contact with the adjacent ink form roller 17. In the fourth position, the bridge roller ;75 is separated from the transition roller 173 by a gap; the bridge roller is however in contact with the adjacent ink form roller 17.

Referring to FIG. 12, the bridge roller 175 is actuated between the third and fourth positions by a rotary actuator 221 and an opposing spring 223 on each end. The spring 223 is located in the slot 219 of the bridge bracket and acts to force the bridge roller 175 away from the transition roller 173. The pneumatic actuators 221 are mounted onto the frame 31. The actuators 221 are a conventional, commercially available unit. Each actuator has a slotted arm 225. The slotted arm 225 forms part of a two-bar linkage between the actuator 221 and the bridge bracket 215. A bar 227 extends between the slotted arm 225 and the bridge bracket. One end of the bar 227 is coupled to the arm 225 such that the bar can slide within the slot. The other end of the bar 227 is coupled to a cam 229 which is pivotally coupled to the bridge bracket 215 by a pin (see FIG. 11). The cam 229 contacts the free end of a lever 231, whose fixed end is pivotally coupled to the bridge bracket 215. The lever 231 is generally perpendicular to an imaginary line connecting the longitudinal axes of the transition and bridge rollers 173, 175. The lever 231 is positioned such that the shaft of the bridge roller 175 is interposed between the lever and the spring 223. A threaded shaft 233 extends from the lever 231 to bear on the shaft of the bridge roller 175.

The actuator 221 rotates the slotted arm 225 180 degrees and then reverses its direction. Thus, with reference to FIG. 12, the actuator 221 would rotate the arm 225 in a clockwise direction for 180 degrees. Then, the actuator would rotate the arm 225 in a counterclockwise direction. As the slotted arm 225 rotates, the bar 227 turns the cam 229 which alternately pushes the lever 231 and the bridge roller 175 towards the transition roller 173 or allows the spring 223 to push the bridge roller and the lever away from the transition roller. The bridge roller 175 is moved between the third and fourth positions in this manner.

Figure 13:
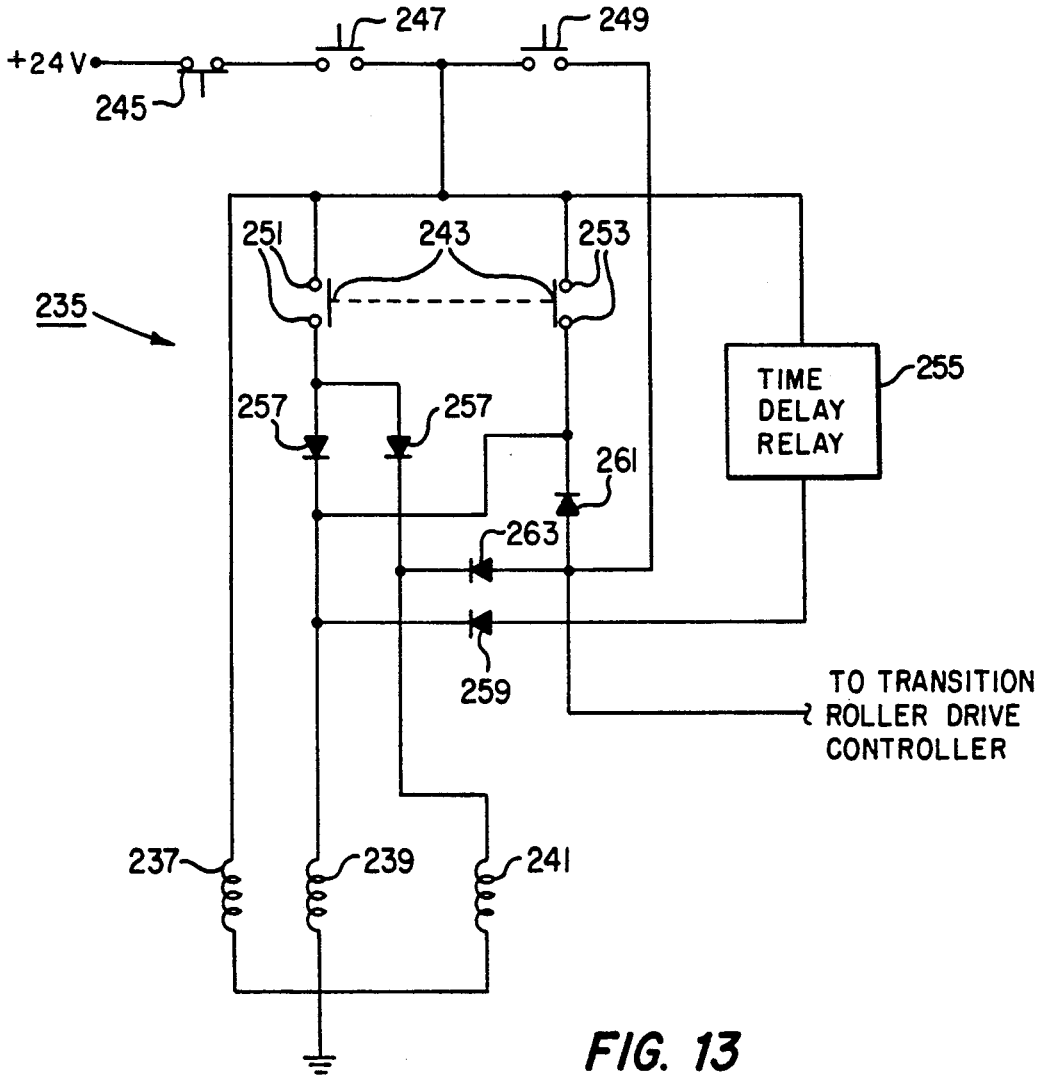
FIG. 13 is a schematic diagram showing the position controller of the dampening system of FIG. 10.

With the dampening system 171 of FIGS. 10–12, both the speed and position of the rollers in the dampening system can be controlled. The speed of the rollers is controlled with the speed controller 151 shown in FIG. 9 and described hereinabove. The position of the rollers is controlled by the position controller 235, shown in FIG. 13.

In the preferred embodiment, the rollers are moved between their positions by four way solenoid valves 81 that control the respective air cylinders (see FIG. 14). Thus, there is a solenoid valve 237 for the transfer roller 23, a solenoid valve 239 for the transition roller 173 and a solenoid valve 241 for the bridge roller 175.

The position controller 235 controls each of these solenoid valves. The controller 235 has a three position switch 243, a unit off switch 245, a unit on switch 247 and a clean switch 249. The unit off switch 245 and the unit on switch 247 are connected together in series to a +24 volt power supply. The unit off switch 245 is normally closed, while the unit on switch 247 is normally open. The unit on switch 247 is connected to the transfer roller solenoid 237, both sets 251, 253 of contacts in the switch 243, a time delay relay 255 and the clean switch 249. The clean switch 249 is normally open. One terminal of the first set of contacts 251 of the switch 243 is connected, via diodes 257, to the transition roller and bridge roller solenoids 239, 241. The time delay relay 255 is connected, via a diode 259, in parallel to the first set of contacts 251. One terminal of the second set of contacts 253 is connected to the transition roller solenoid 239. The clean switch 249 is connected to the transition roller and the bridge roller solenoids 239, 241, and one terminal of the second set of contacts 253, by way of diodes 261, 263, and to an input in the transition roller drive controller 159 in the speed controller 151.

The operation of the dampening system 171 will now be described. Electrical power is applied to the speed and position controllers and to the motors by closing the unit on switch 247. When the unit on switch 247 is closed, the transfer roller solenoid 237 is energized, thereby bringing the transfer roller 23 into contact with the transition roller 173.

The dampening system 171 can operate in several modes to adapt to the particular requirements of a printing run. The particular mode that the dampening system is in is determined by the position of the three position switch 243. In the first mode, the transition roller 173 is in the second position, in contact with the plate cylinder, while the bridge roller 175 is in the fourth position, out of contact with the transition roller. In the second mode, the transition roller is in the first position, off of the plate cylinder, and the bridge roller is in the third position, in contact with the transition roller. In the third mode, the transition roller is in the second position and the bridge roller is in the third position.

When an operator selects the first mode, the first set of contacts 251 is closed, while the second set of contacts 253 is open. In the first mode, the transition roller solenoid 239 is energized, thereby bringing the transition roller 173 into contact with the plate cylinder 11 (see FIG. 10). In addition, the bridge roller solenoid 241 is energized, moving the bridge roller 175 out of contact with the transition roller 173 so as to create a gap between the two rollers. The transition roller 173 rotates at the same surface speed as the plate cylinder 11 (within manufacturing tolerances). The transition roller 173 acts as a dampening form roller, applying dampening fluid to the plate cylinder 11.

During operation of the press, hickeys will accumulate on the plate cylinder 11. These hickeys can be cleaned or picked off by closing the clean switch 249, wherein the manual speed control 165 is connected to an input in the transition roller drive controller 159. This action slows down the transition roller 173, so that a differential surface speed exits between the plate cylinder and the transition roller, wherein the hickeys are cleaned off of the plate cylinder. The hickeys are carried by the rollers to the pan 21 where then can be filtered out of the dampening system. The gap between the bridge and transition rollers 175, 173 prevents hickeys from being carried into the inking system. When the clean switch 249 is opened, the transition roller 173 returns to the same surface speed as the plate cylinder. The speed controller 151 tracks the speed of the plate cylinder so that any variation in speed will be mimicked by the transition roller. In addition, the speed controller monitors the load on the transition roller motor 115, so as to regulate the speed of the motor 71.

In the second mode, both sets of contacts 251, 253 are open, wherein the transition roller solenoid 239 is deenergized, moving the transition roller 173 off of the plate cylinder 11. The bridge roller solenoid 241 is also deenergized, bringing the bridge roller 175 into contact with the transition roller 173. The dampening system thus operates as shown in FIG. 1, wherein dampening fluid is applied to the plate cylinder by way of the inking rollers 17. The transition roller 173 rotates at the same surface speed as the plate cylinder 11. When the clean switch 249 is closed to clean hickeys off of the plate cylinder, both the transition roller solenoid 239 and the bridge roller solenoid 241 are energized, moving the transition roller 173 into contact with the plate cylinder 11 and the bridge roller 175 away from, and out of contact with, the transition roller. The transition roller 173 is rotated at a slower surface speed than the plate cylinder. When the clean switch 249 is opened, the rollers return to their positions for the second mode.

In the third mode, the first set of contacts 251 are open and the third set of contacts 253 are closed. The transition roller solenoid 239 is energized, moving the transition roller 171 into contact with the plate cylinder 11. The bridge roller solenoid 241 is not energized, due to the diode 261. Thus, the bridge roller 175 remains in contact with the transition roller 173, mechanically following the movement of the transition roller to the plate cylinder. The transition roller 173 rotates at the same surface speed as the plate cylinder 11. In the third mode, some dampening fluid is applied to the plate cylinder 11 by the transition roller 173 and some is applied by the ink form rollers 27. When the clean switch 249 is closed, the bridge roller solenoid 241 is energized, thereby moving the bridge roller 175 out of contact with the transition roller 173, as shown in FIG. 10. The transition roller 173 is slowed down by the transition roller drive controller 159, to clean hickeys off of the plate cylinder Il. When the clean switch 249 is opened, the rollers return to the third mode.

The dampening system is typically operated in the hickey picking mode, with the clean switch 249 closed, for a few revolutions of the plate cylinder. This is typically sufficient to clean the plate cylinder. After a few revolutions, the clean switch is opened and the dampening system is returned to whatever mode it was operating in.

When the dampening system 171 is first started up, the unit on switch 247 is closed, and the transfer roller solenoid is energized bringing the transfer roller into contact with the transition roller in order to predampen the plate cylinder. The time delay relay 255 provides a closed circuit so as to bypass the three position switch 243 and energize the transition roller solenoid 239, wherein the transition roller 173 is brought into contact with the plate cylinder 11. This allows the transition roller 173 to apply dampening fluid directly to the plate cylinder immediately upon startup, enabling the rapid achievement of ink-water balance on the printing plate. After a short length of time corresponding to a few revolutions of the plate cylinder, the time delay relay 255 opens, thereby returning the transition roller to whatever mode it was in. This automatic predampening aspect is most useful when the second mode is selected, wherein the transition roller is off of the plate cylinder. The controller 235 is switched off by opening the unit off switch 245.

With the dampening system of the present invention, several improvements are obtained over the prior art. One such improvement, which has already been discussed, is the ability to operate without isopropyl alcohol. This is a significant improvement over prior art dampening systems, which either require the use of alcohol or alcohol substitutes, or cloth covered rollers. The dampening system, of the present invention requires neither alcohol nor cloth covered rollers. It is believed that the dampening system operates by providing plural nips where the rollers rotate at differential speeds so as to mix the dampening fluid into the ink before the dampening fluid is applied to the plate cylinder. In some instances, an alcohol substitute or wetting agent may be required in order to assist the mixing of the dampening fluid into the ink. Whether or not an alcohol substitute should be used can be determined on a trial and error basis by first operating the press without an alcohol substitute The printed sheets are checked for print quality and particularly to determine if the ink is "emulsified". "Emulsification" is indicated if the ink on the printed paper loses color and fades. Such a condition is caused by too much dampening fluid or by improper mixing of the dampening fluid into the ink before being applied to the plate cylinder. If it is found that the ink is "emulsified", the dampening system mode can be changed, nip pressures adjusted and roller speeds varied. If after these adjustments, there still is "emulsification", then a quantity of alcohol substitute can be added to the dampening fluid. The need for an alcohol substitute is dependent on many parameters, such as the chemistry of the particular ink being applied to the plate cylinder, the chemistry of the water in the dampening fluid (which varies according to the local water supply), the type of stock being printed on, the type of ink coverage (type, blocks, etc.) and the temperature of the press room. The dampening system of the present invention provides flexibility in meeting these variable parameters.

Another such improvement is the reduced wear on the printing plate. Prior art dampening systems utilize differentially driven form rollers in contact with the printing plate on the plate cylinder in order to clean hickeys off of the plate. The form rollers remain in constant contact with the plate cylinder. This provides constant cleaning of hickeys, but also produces increased wear on the printing plate. If the printing plate is worn before the printing job is finished, then it must be replaced with a new plate, resulting in down time of the press. With the dampening system of the present invention, plate wear is reduced because the amount of time that the transition roller is rotating at a differential speed with respect to the plate cylinder and in contact with the plate cylinder is minimized and broken into short intervals of time.

Still another improvement is that the hickeys that are cleaned off of the plate cylinder are unable to enter the inking system where they can be reapplied to the plate cylinder. Instead the hickeys are removed from the press by way of the dampening fluid.

With the dampening system of the present invention, the efficiency of the press is increased. The startup time of the press is reduced because the transition roller can be brought into contact with the plate cylinder to quickly predampen the plate cylinder. Furthermore, the dampening system provides for minimal usage of alcohol substitutes, which glaze rollers and require cleaning.

With the dampening system in the third mode, the transition roller is an additional form roller that is against the plate cylinder. The dampening and inking systems are interconnected at a point separate from the plate cylinder, by way of the bridge roller. We have found that a more uniform layer of ink and dampening fluid can be applied to the plate cylinder with this arrangement. This is particularly desirable for some types of inks. It is also believed that the dampening system of the present invention enhances print quality by enabling finer resolution printing, particularly in large blocks of inked areas.

Furthermore, the provision of the controller 151 for automatically adjusting the amount of dampening fluid being brought up by the transfer and metering rollers automatically maintains the desired ink-water balance in spite of changing press conditions This provides for more uniform print during a press run and frees the operator to perform other tasks during the operation of the press.

The foregoing disclosure and the showings made in the drawings are merely illustrative of the principles of this invention and are not to be interpreted in a limiting sense.

We claim:

1. A dampening system for a lithographic printing press, said press comprising inking rollers for applying ink to a plate cylinder, comprising:

(a) a pan for containing dampening fluid;

(b) first and second dampening rollers, said first and second dampening rollers being in contact with each other at a nip, one of said first and second dampening rollers being located in said pan so as to pick up dampening fluid from said pan, one of said first and second dampening rollers being hydrophilic;

(c) first drive means for rotating said first and second dampening rollers;

(d) a transition roller that is ink receptive, said transition roller being in rotative contact with one of said first and second dampening rollers and being adapted to be rotatively coupled with one of said inking rollers, said transition roller creating a path for said dampening fluid from said pan to said plate cylinder by way of said transition roller and said inking rollers when said dampening system is mounted to said press, wherein dampening fluid is applied to said plate cylinder only through said inking rollers when said dampening system is mounted to said press;

(e) second drive means for rotating said transition roller at a surface speed that is independent of the surface speeds of said first and second dampening rollers and of said press inking rollers and said plate cylinder, said second drive means comprising means for allowing the surface speed of said transition roller to be independently adjusted during operation of said dampening system and said press, wherein said press can be operated free of alcohol and other wetting agents.

2. The dampening system of claim 1 further comprising a bridge roller interposed between said transition roller and said inking rollers such that said bridge roller contacts said transition roller and said one inking roller that is rotatively coupled with said transition roller.

3. The dampening system of claim 2 wherein said transition roller has an outer surface with a Shore A durometer of between 20–35.

4. The dampening system of claim 1 wherein said first dampening roller is located in said pan, said transition roller contacting said second dampening roller, and said second dampening roller rotating at a faster surface speed than does said first dampening roller.

5. A lithographic printing press, comprising:

(a) a plate cylinder;

(b) inking rollers for applying ink to said plate cylinder, said inking rollers comprising ink form rollers that contact said plate cylinder;

(c) a pan for containing dampening fluid;

(d) first and second dampening rollers, said first and second dampening rollers being in contact with each other at a nip, one of said first and second dampening rollers being located in said pan so as to pick up dampening fluid from said pan, one of said first and second dampening rollers being hydrophilic;

(e) first drive means for rotating said first and second dampening rollers;

(f) a transition roller that is ink receptive, said transition roller being in contact with one of said first and second dampening rollers and being in contact with one of said inking rollers, said transition roller creating a path for said dampening fluid from said pan to said plate cylinder by way of said transition roller and said inking rollers, wherein dampening fluid is applied to said plate cylinder only through said inking rollers;

(g) second drive means for rotating said transition roller at a surface speed that is independent of the surface speeds of said first and second dampening rollers and of said press inking rollers and said plate cylinder, said second drive means comprising means for allowing the surface speed of said transition roller to be independently adjusted during operation of said dampening system and said press, wherein said press can be operated free of alcohol and other wetting agents.

6. A dampening system for a lithographic printing press, said press comprising inking rollers for applying ink to a plate cylinder, comprising:

(a) a pan for containing dampening fluid, said pan being mounted to a frame, said frame being adapted to mount onto said press;

(b) first and second dampening rollers rotatably mounted to said frame, said first and second dampening rollers being in contact with each other at a nip, one of said first and second dampening rollers being located in said pan so as to pick up dampening fluid from said pan;

(c) first drive means for rotating said first and second dampening rollers;

(d) a transition roller adapted for applying dampening fluid to said plate cylinder, said transition roller being in contact with one of said first and second dampening rollers;

(e) mounting means for rotatably mounting said transition roller to said frame, said mounting means allowing said transition roller to be movable between first and second positions, wherein when said transition roller is in said first position, said transition roller is adapted to be rotatively coupled to one of said inking rollers and said transition roller creates a path for said dampening fluid from said pan to said plate cylinder by way of said transition roller and said inking rollers, wherein said dampening fluid is applied to said plate cylinder only by way of said inking rollers, and when said transition roller is in said second position, said transition roller is adapted to break said rotative coupling with said one inking roller and said transition roller is adapted to contact said plate cylinder when said dampening system is mounted to said press;

(f) second drive means for rotating said transition roller at speeds independently of said press inking rollers and said plate cylinder, said second drive means comprising means for rotating said transition roller at a speed that is different from the speed of the plate cylinder when said transition roller is in said second position, wherein said transition roller is adapted to remove hickeys from said plate cylinder, which hickeys are carried to said pan.

7. The dampening system of claim 6 further comprising a bridge roller that is rotatably coupled to said frame such that said bridge roller contacts said transition roller when said transition roller is in said first position, said bridge roller being adapted to contact said one inking roller when said frame is mounted onto said press such that said bridge roller is interposed between said transition roller and said one inking roller.

8. The dampening system of claim 6 wherein said transition roller has an outer surface with a Shore A durometer of between 20–35.

9. The dampening system of claim 6 further comprising actuation means for moving said transition roller between said first and second positions, said actuation means being coupled with said frame and being coupled to said mounting means.

10. The dampening system of claim 9, wherein said actuation means comprises an air cylinder on each end of said transition roller.

11. The dampening system of claim 6, wherein said mounting means comprises a bracket on each end of said transition roller, said brackets being pivotally coupled to said frame such that said transition roller pivots between said first and second positions.

12. The dampening system of claim 6 further comprising:

(a) a bridge roller that is rotatably coupled to said frame such that said bridge roller contacts said transition roller when said transition roller is in said first position, said bridge roller being adapted to contact said one inking roller when said frame is mounted onto said press such that said bridge roller is interposed between said transition roller and said one inking roller;

(b) said transition roller has an outer surface with a Shore A durometer with 20–35;

(c) said mounting means comprises a bracket on each end of said transition roller, said brackets being pivotally coupled to said frame such that said transition roller pivots between said first and second positions;

(d) actuation means for moving said transition roller between said first and second positions, said actuation means being coupled with said frame and being coupled to said brackets.

13. The dampening system of claim 7, further comprising means for selectively separating said bridge roller from said transition roller when said transition roller is in said second position.

14. A dampening system for a lithographic printing press, said press comprising inking rollers for applying ink to a plate cylinder, comprising:

(a) a pan for containing dampening fluid, said pan being mounted to a frame, said frame being adapted to mount onto said press;

(b) first and second dampening rollers rotatably mounted to said frame, said first and second dampening rollers being in contact with each other at a nip, one of said first and second dampening rollers being located in said pan so as to pick up dampening fluid from said pan, one of said first and second dampening rollers having a hydrophilic surface;

(c) a transition roller rotatably mounted to said frame by brackets, said brackets being pivotally coupled to said frame, said transition roller being in contact with one of said first and second dampening rollers, said transition roller having an ink receptive surface;

(d) a bridge roller rotatably mounted to said frame so as to be adapted to contact one of said inking rollers, said bridge roller being ink receptive;

(e) first drive means for rotating said first and second dampening rollers;

(f) actuation means for actuating said transition roller between first and second positions by moving said brackets, said first position being where said transition roller contacts said bridge roller such that dampening fluid is applied to said plate cylinder through said inking rollers when said dampening system is mounted on said press, and said second position being where said transition roller contacts said plate cylinder and does not contact said bridge roller;

(g) second drive means for rotating said transition roller at speeds independently of said press inking rollers and said plate cylinder, said second drive means comprising means for rotating said transition roller at a surface speed that is different than the surface speed of said plate cylinder when said transition roller is in said second position, wherein said transition roller is adapted to remove hickeys from said plate cylinder, which removed hickeys are carried to said pan.

15. A lithographic printing press, comprising:

(a) a plate cylinder;

(b) inking rollers for applying ink to said plate cylinder, said inking rollers comprising ink form rollers that contact said plate cylinder;

(c) a pan for containing dampening fluid, said pan being mounted to a frame, said frame being mounted to said press;

(d) first and second dampening rollers rotatably mounted to said frame, said first and second dampening rollers being in contact with each other at a nip, one of said first and second dampening rollers being located in said pan so as to pick up dampening fluid from said pan;

(e) first drive means for rotating said first and second dampening rollers;

(f) a transition roller for applying dampening fluid to said plate cylinder, said transition roller being in contact with one of said first and second dampening rollers;

(g) mounting means for rotatably mounting said transition roller to said frame, said mounting means allowing said transition roller to be movable between first and second positions, wherein when said transition roller is in said first position said transition roller is rotatively coupled to one of said inking rollers such that said dampening system applies dampening fluid to said plate cylinder by way of said one inking roller, and when said transition roller is in said second position, said transition roller contacts said plate cylinder and does not contact said one inking roller;

(h) second drive means for rotating said transition roller at speeds independently of said inking rollers and said plate cylinder, said second drive means comprising means for rotating said transition roller at a speed that is different from the speed of the plate cylinder when said transition roller is in said second position, wherein said transition roller can remove hickeys from said plate cylinder, which hickeys are carried to said pan.

* * * * *